United States Patent [19]

Lakic

[11] Patent Number: 5,025,575

[45] Date of Patent: Jun. 25, 1991

[54] INFLATABLE SOLE LINING FOR SHOES AND BOOTS

[76] Inventor: Nikola Lakic, 45-191 Elm St., Indio, Calif. 92201

[21] Appl. No.: 427,515

[22] Filed: Oct. 27, 1989

Related U.S. Application Data

[63] Continuation-in-part of Ser. No. 323,340, Mar. 14, 1989, and a continuation-in-part of Ser. No. 262,749, Oct. 29, 1988.

[51] Int. Cl.[5] ..... A43B 13/41; A43B 13/38

[52] U.S. Cl. ..... 36/44; 36/29; 36/3 B

[58] Field of Search ..... 36/28, 29, 3 R, 3 B, 36/119, 43, 44, 93, 117

[56] References Cited

U.S. PATENT DOCUMENTS

| | | | |
|---|---|---|---|
| 2,979,835 | 4/1961 | Scholl | 36/44 |
| 3,225,463 | 12/1965 | Burnham | 36/29 |
| 3,475,836 | 11/1969 | Brahm | 36/3 R |
| 3,716,930 | 2/1973 | Brahm | 36/3 R |
| 3,973,336 | 8/1976 | Ahn | 36/3 R |
| 4,063,371 | 12/1977 | Batra | 36/3 R |
| 4,106,222 | 8/1978 | Houck | 36/29 |
| 4,123,855 | 11/1978 | Thedford | 36/29 |
| 4,183,156 | 1/1980 | Rudy | 36/44 |
| 4,236,725 | 12/1980 | Bataille | 36/29 |
| 4,361,969 | 12/1982 | Vermonet | 36/88 |
| 4,567,677 | 2/1986 | Zona | 36/28 |
| 4,631,843 | 12/1986 | Annovi | 36/93 |
| 4,718,179 | 1/1988 | Brown | 36/71 |
| 4,730,403 | 3/1988 | Walkhoff | 36/93 |
| 4,763,426 | 8/1988 | Polus et al. | 36/29 |
| 4,776,110 | 10/1988 | Shiang | 36/44 |

FOREIGN PATENT DOCUMENTS

| | | | |
|---|---|---|---|
| 8703789 | 7/1987 | PCT Int'l Appl. | 36/29 |

*Primary Examiner*—Steven N. Meyers

*Attorney, Agent, or Firm*—Plante Strauss Vanderburgh & Connors

[57] ABSTRACT

There is disclosed the combination of an inflatable inner sole and a supporting underlayment for footwear, such as a shoe, boot or sandal. The inflatable inner sole is formed of upper and lower plastic sheets having the shape and size of a sole and bonded together in a continous seam about their peripheral edges thereby forming a sealed interior. A plurality of this continuous seams are formed between the upper and lower sheets to create within the sealed interior a plurality of interconnecting tubular passageways. The inflatable inner sole is provided with an air pump that preferably is mounted at the heel of the inner sole. The air pump is a flexible bulb with an inlet valve and discharges into a flexible tube which extends to a pressure control valve and then to the interior chamber of the inflatable inner sole. The pressure relief valve is manually adjustable to control the pressure within the inflatable inner sole. Excess air from the pressure control valve is directed into channels formed on the undersurface of the inner sole where it discharges through sealed apertures in the inner sole thereby providing forced air circulation in the shoe. Alternatively a manually operated air pump can be provided and the inner sole can be provided with inflatable upper linings for the shoe or boot.

25 Claims, 26 Drawing Sheets

INFLATABLE SOLE LINING FOR SHOES AND BOOTS

RELATIONSHIP TO OTHER APPLICATIONS

This application is a continuation-in-part of my copending application, Ser. No. 323,340, filed on Mar. 14, 1989, now and a continuation-in-part of my copending application, Ser. No. 262,749, filed on Oct. 29, 1988.

BACKGROUND OF THE INVENTION

1. Field of the Invention

This invention relates to an inflatable lining for shoes, boots and the like, and in particular, relates to an inflatable lining with a pump to pressurize the lining and induce air circulation through the shoe.

2. Brief Statement of the Prior Art

Inner soles have been provided for shoes and boots which are formed of a compressible, elastic material such as cellular plastic foams, foam rubber, etc. These inner soles have provided only limited shock absorbency, resulting in little or no significant improvement in wearer comfort.

Some prior investigators have provided inner soles with inflated cushions at either the toe and heel areas, and some have provide cushions at both areas with circulation between the two cushions. The cushions have been provided with mechanisms to circulate air and ventilate the shoe or boot during walking activities. Examples of these are: U.K. Pat. Nos. 2,189,679 and 357,391; U.S. Pat. Nos. 3,180,039, 2,716,293, 1,213,941 and German Pat. No. 3,144,207.

In some foot apparel, notably in ski boots, an outer shell is molded from plastic and is lined with an inner shoe. Adjustment has been made to the tightness of the outer shell and air bags have been provided across the instep region of the shoe, and elsewhere, and have been provided with an air pump to pressure the air bags, creating pressure about the foot and snugness of the fit of the ski boot. U.S. Pat. No. 4,730,403 and German Pat. No. 2,321,817 are representative of these ski boots.

A water-filled inner sole for shoes has recently been marketed under the tradename "Walk On Water". While this is an attempt to increase wearer comfort, water is heavy, non-compressible and the inner sole cannot be adjusted for firmness, and cannot provide shock absorbency. Additionally, water is unsuited for use in freezing climates. Also, a leak will wet the inside of the bootwear, and this inner is not breathable.

None of the aforementioned prior devices provides a simple, inexpensive solution to comfortable wear and walking in a shoe or boot. The foam inner soles have only a limited value and limited shock absorbency. The remainder of the prior devices, including the pressurization system for ski boots are relatively complex and costly and are often too bulky and cumbersome. Consequently, these devices are not readily acceptable for everyday activities.

OBJECTIVES OF THE INVENTION

It is an objective of this invention to provide an inflatable inner sole with an integral air pump for pressurization.

It is also an objective of this invention to provide the aforementioned inner sole with the air pump strategically located such that the normal walking activities will inflate and pressurize the inner sole.

It is a further objective of this invention to provide the aforementioned inflatable inner sole with an inexpensive construction.

It is also a further object to provide an inner sole with an arch pillow and a contour conforming to the wearer's foot, which preferably will massage the wearer's foot.

It is a further objective of this invention to provide air circulation channels and apertures in the aforementioned inner sole whereby normal walking activities will force air circulation through the inner sole and shoe.

It is a further objective of this invention to provide an inflatable inner sole with an integral air pump which can be operated manually.

It is a further objective of this invention to provide a liner for a boot that provides an inflatable inner sole and an inflatable upper lining which also can be pressured with an air pump and which can provide forced air circulation through a boot.

BRIEF DESCRIPTION OF THE INVENTION

This invention comprises an inflatable inner sole for footwear which is formed of upper and lower plastic sheets having the shape and size of a sole and bonded together in a continuous seam about their peripheral edges thereby forming a sealed interior. A plurality of this continuous seams are formed between the upper and lower sheets to create within the sealed interior a plurality of interconnecting tubular passageways. The inflatable inner sole is provided with an air pump that preferably is contained within a preselected region of the inner sole, preferably directly beneath the heel. For this purpose, an opening is formed in the plastic sheets to receive the air pump, and a continuous seam is provided, preferably in the form of a circular seam, about the opening. The air pump is a flexible resilient bulb with an inlet valve and has a discharge port opening into a flexible tube which extends, preferably, to a pressure control valve and then to the interior chamber of the inflatable inner sole. The pressure relief valve preferably is manually adjustable to control the pressure within the inflatable inner sole. Excess air from the pressure control valve is directed into channels formed on the undersurface of the inner sole where it discharges through sealed apertures in the inner sole into the shoe.

In other embodiments of the invention, the air pump can be provided at one side of the inflatable inner sole for manual, hand manipulation or the inner sole can be provided with one or more side tabs to line upper portions of a shoe or boot. In these embodiments a manual or hand pump can be incorporated on the side tabs.

Preferably the seams are provided with a plurality of through perforations extending entirely through the upper and lower sheets to provide air and fluid communication through the inner sole.

BRIEF DESCRIPTION OF THE DRAWINGS

The invention will be described with reference to the figures of which.

DESCRIPTION OF PREFERRED EMBODIMENTS

Figure 1:
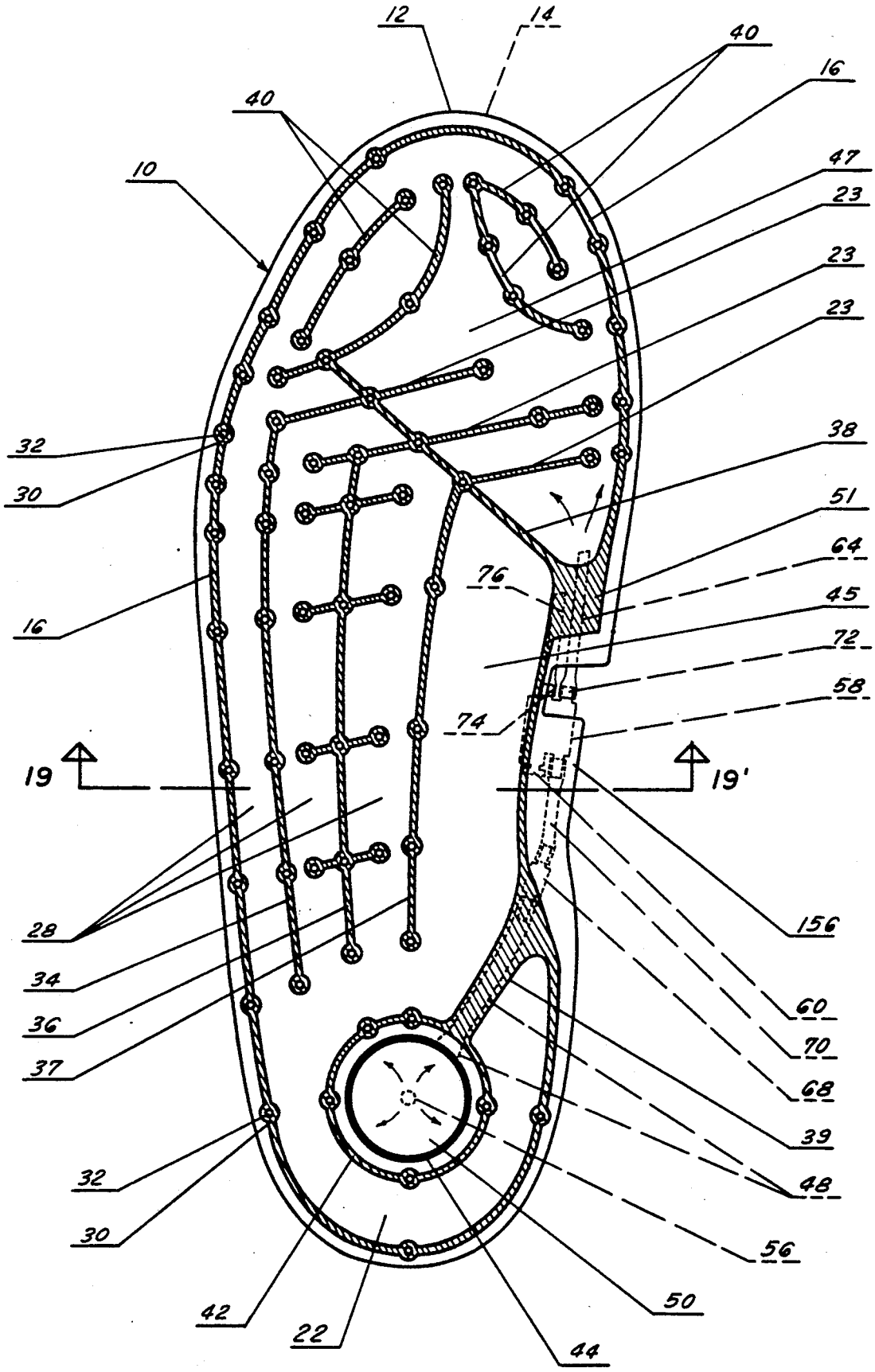
FIG. 1 is a plan view of an inflatable inner sole with a pump and adjustable relief valve.

Referring now to FIG. 1, the inflatable inner sole 10 of the invention is shown in plan view. The inner sole 10 is formed by a lower sheet 14 and a coextensive upper sheet 12 of substantially the same shape and size. The upper and lower sheets 12 and 14 are bonded together in a continuous peripheral seam 16 that extends about the toe, the lateral side of the inner sole 10, the heel and medially about the instep. The seams are shown in the figures as cross hatched areas. This is intended to show seamed areas only and not to represent sectional views.

The upper and lower sheets 12 and 14 are preferably plastic and most preferably are thermoplastic, so that conventional heat sealing can be used for forming the seams. The most preferred thermoplastic material is polyurethane, however, other suitable materials include ethylene, and ethylene vinyl acetate copolymers, polyethylene, polypropylene, polyvinyl chloride, etc. Natural or synthetic rubber can also be used.

The upper sheet 12 and lower sheet 14 are also bonded together with a plurality of discontinuous seams 34, 36 and 37 which form tubular, interconnecting passageways 28 through the inner sole 10. The spacing between adjacent seams controls the size (diameter) of the passageways 28. Also, unseamed expanses will form air pillows such as the arch pillow 45 and toe pillow 47. The size and space of the pillows can easily be varied during manufacture to adapt the innersole to the particular shoe. Thus, if intended to fit conventional shoes with integral arch supports, the arch pillow can be reduced in size. It can also be enlarged for use with shoes having flat or near flat soles, to provide an arch support, the firmness of which can be regulated by adjustment of the air pressure within the innersole.

Preferably, the seams have a plurality of through perforations or apertures 32 which extend entirely thorough the upper and lower sheets 12 and 14 and are entirely surrounded by a seamed area 30. For this purpose, the seams can be expanded to provide an annular seam area 30 that entirely surrounds each circular aperture 32 through the upper and lower plastic sheets. Each seam and seamed channels along the upper and lower sheets, described with reference to FIGS. 19-21, and the apertures 32 establish communication between the channels above and below the inner sole 10.

As illustrated, the instep is provided with several longitudinal discontinuous seams 34, 36 and 37 which extend to a generally transverse discontinuous seam 38 that subdivides the instep from the toe of the inner sole 10. The toe is also subdivided into tubular passageways by additional discontinuous seams such as 40. Seams 23 are provided transversely across the area between the toe and instep to improve the flexing of the inner sole 10 in this area. The spacing, size and number of these discontinuous seams can be varied greatly, as desired, to provide the maximum comfort and convenience to the wearer of a shoe fitted with the inflatable inner sole.

At the heel of the inflatable inner sole 10, a continuous loop seam 42 is provided, preferably as a circle surrounding a circular aperture 44 which extends through the upper and lower plastic sheets. The circular aperture 44 receives the air pump 50 of the invention. The air pump 50 has an inlet port along its bottom surface with a flapper valve 56 (described in greater deal hereinafter) and is functional to discharge air through an integral flexible tube 48 toward pressure control valve 58. The flexible tube 48 is placed beneath a wide seam 39, lying in the channel formed on the undersurface of the inner sole 10 by seam 39. Check valve 68 is also connected between tube 48 and flexible tube 70 which is connected to the pressure control valve 58.

The pressure control valve 58, also described in greater detail hereinafter, has a manual adjustment knob 60 for the controlled fixed adjustability of the pressure within the inflatable inner sole 10. The pressure control valve 58 has a discharge port 72 which is connected to a flexible tube 64 that extends through the continuous peripheral seam 16 and discharges directly into the sealed interior between the first and second plastic sheets, preferably into the toe of the inflatable inner sole.

Figure 2:
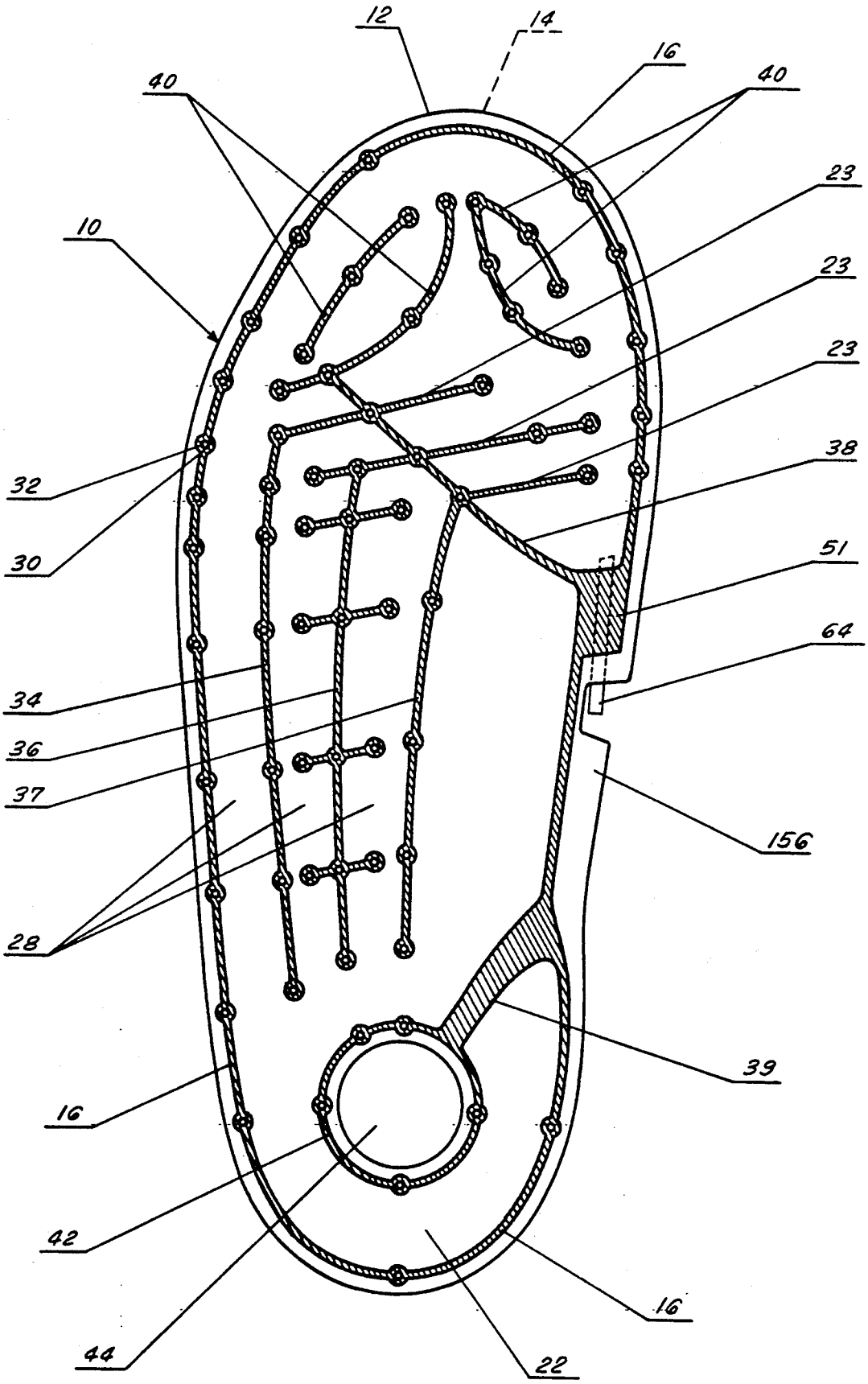
FIG. 2 is a view of the inner sole of FIG. 1 without the air pump and pressure relief valve.

Referring now to FIG. 2, there is illustrated a plan view of the inflatable inner sole 10 without the pressure relief valve and the air pump. As there illustrated, the flexible tube 64 which communicates through the peripheral seam 16 is permanently positioned in the inflatable liner.

Figure 3:
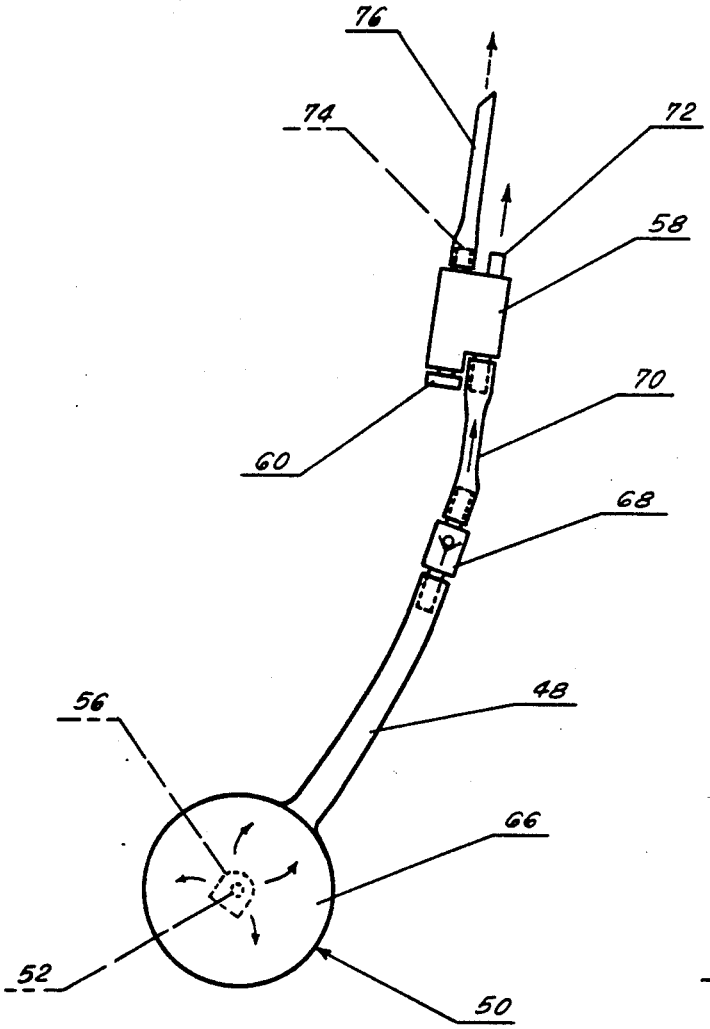
FIG. 3 illustrates the pump and relief valve assembly which is used with the inflatable inner sole of FIG. 1.

Referring to FIG. 3, there is illustrated a plan view of the air pump 50 and pressure control valve 58 used in the inflatable inner sole shown in FIG. 1. As there illustrated, the air pump 50 comprises a generally flat, flexible, resilient bulb 66 that has an internal flapper valve 56 that seals an inlet port, aperture 52, in its bottom wall. The air pump is integrally connected to a flexible tube 48 that discharges through a check valve 68 and into a short flexible tube 70 which is connected to the pressure relief valve 58. The pressure relief valve 58 has two discharge ports 72 and 74. Discharge port 72 is in direct communication to the flexible tube 64 that discharges into the toe of the inflatable liner 10, while discharge port 74 is connected to a short flexible tube 76 that discharges externally of the inflatable liner 10. As shown in FIG. 1, tube 76 is preferably placed beneath a wide seamed area 51, lying within the channel formed in the undersurface of the inner sole 10, thereby directing the excess air through these channels where it will flow upwardly through the inner sole 10 via apertures 32. This establishes a forced air circulation in the shoe. Access to the second port 74 is controlled by the internal pressure regulation of the valve 58 which is fixedly adjustable by the adjustment knob 60.

Figure 4:
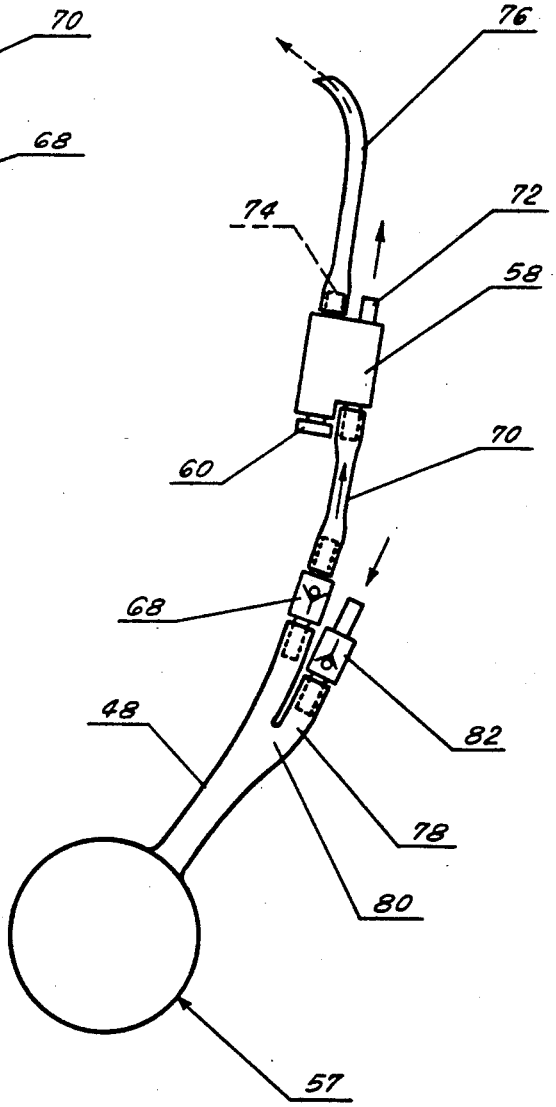
FIG. 4 illustrates an alternative air pump and relief valve assembly for the use with the inflatable inner sole of FIG. 1.

FIG. 4 illustrates an alternative embodiment of an air pump 57 used in the invention. In the embodiment shown in FIG. 4, the flapper valve and inlet port in the bottom surface of the bulb has been removed and an inlet port 78 is provided in a Y-branch 80 of flexible tubing which is connected to a check valve 82 to serve as a fresh air inlet to the system. The remainder of the structure is substantially as described with reference to FIG. 3.

Figure 5:
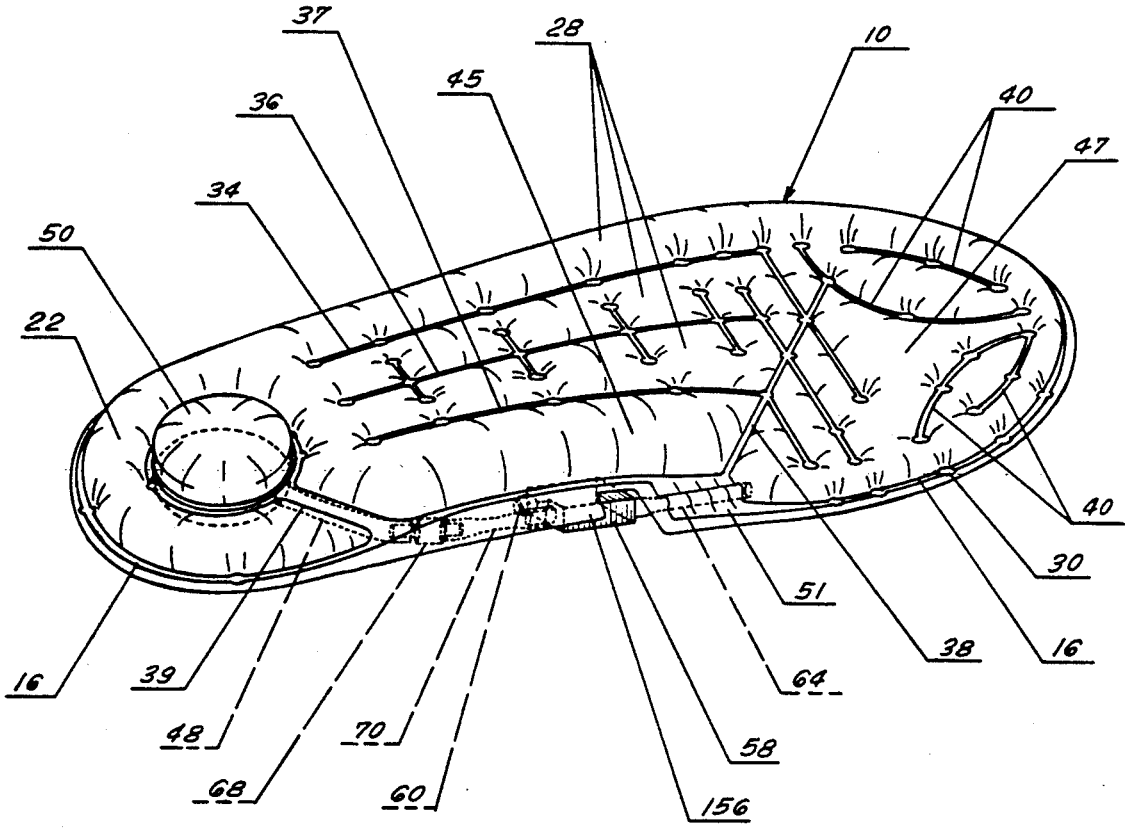
FIG. 5 is a perspective view of the inflatable inner sole of FIG. 1.

The inflatable inner sole 10 of FIG. 1 is shown in perspective view in FIG. 5. The circular aperture 44 at the heel which houses the air pump 50, and the tubular passageways which are formed between the discontinuous seams of the inner sole are apparent in this illustration. Also, the size and position of the pressure control valve 58 and adjustment knob 60 can be seen in the illustration.

Figure 6:
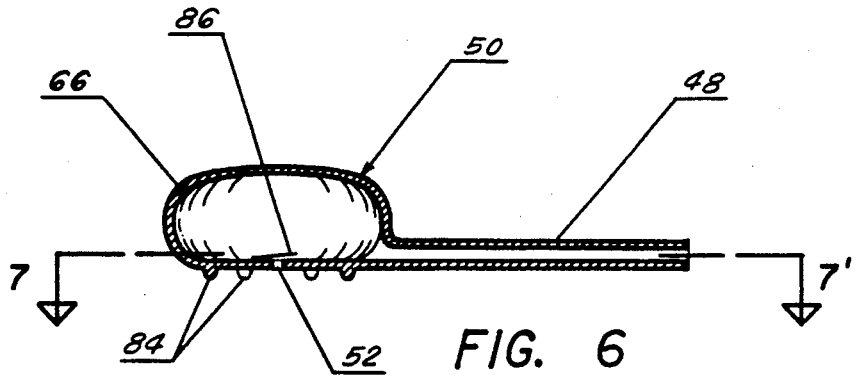
FIGS. 6 and 7 are sectional elevational and plan views of the pump used in the inner sole of FIG. 1.
Figure 7:
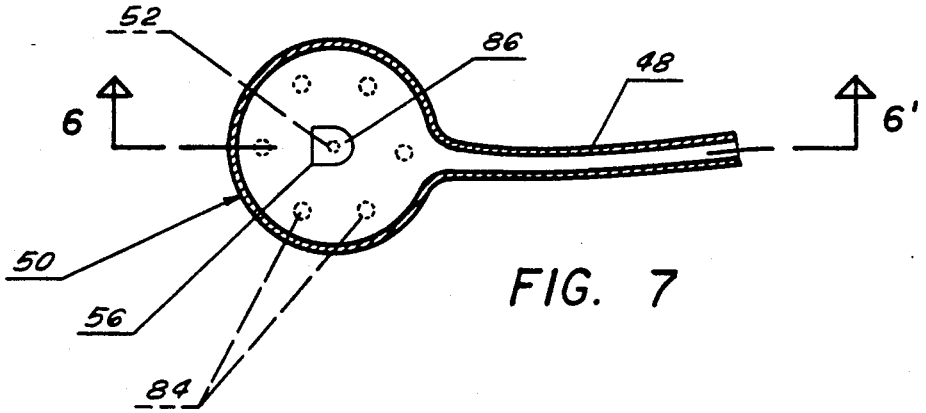

Referring now to FIGS. 6 and 7, the structure of the air pump 50 shown in FIG. 1 will be described in greater detail. FIG. 6 is a sectional view through the air pump 50 and illustrates that the air pump 50 is provided with a plurality of protrusions 84 on the undersurface of its bottom wall to permit free air passage beneath its undersurface. The bottom wall of the air pump is perforated with a single aperture 52 to provide an inlet port to the interior of the air pump and a single flap 86 of flexible plastic extends over this aperture and is hinged at one side edge thereof to function as a flapper valve 56.

Figure 8:
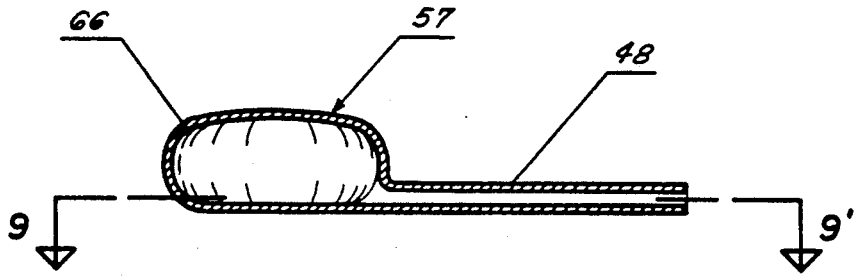
FIGS. 8 and 9 are sectional elevational and plan views of the alternative pump shown in FIG. 4.
Figure 9:
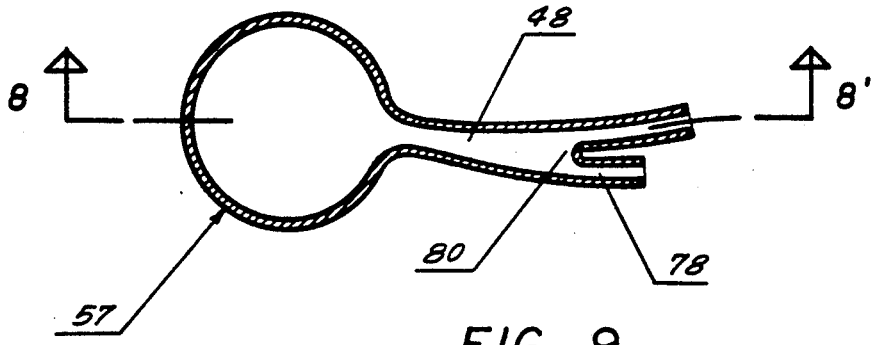

Referring now to FIGS. 8 and 9, the alternative air pump 57 which is shown in FIG. 4 has no protrusions on its bottom wall and does not have the aperture 52 in its bottom wall and the flapper valve 56, as these functions are supplied by the externally mounted check valve 82, previously described with reference to FIG. 4.

Figure 11:
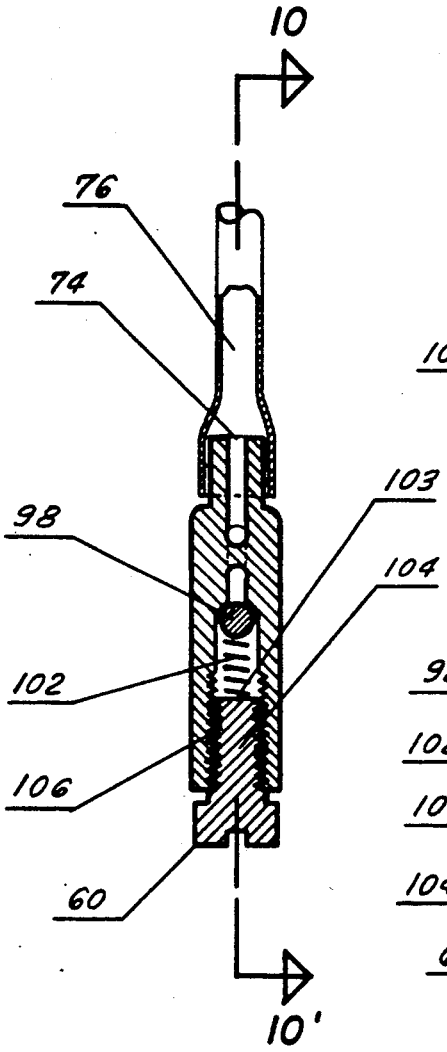
FIGS. 10, 11 and 12 are views of the adjustable pressure control valve used in the invention.
Figure 10:
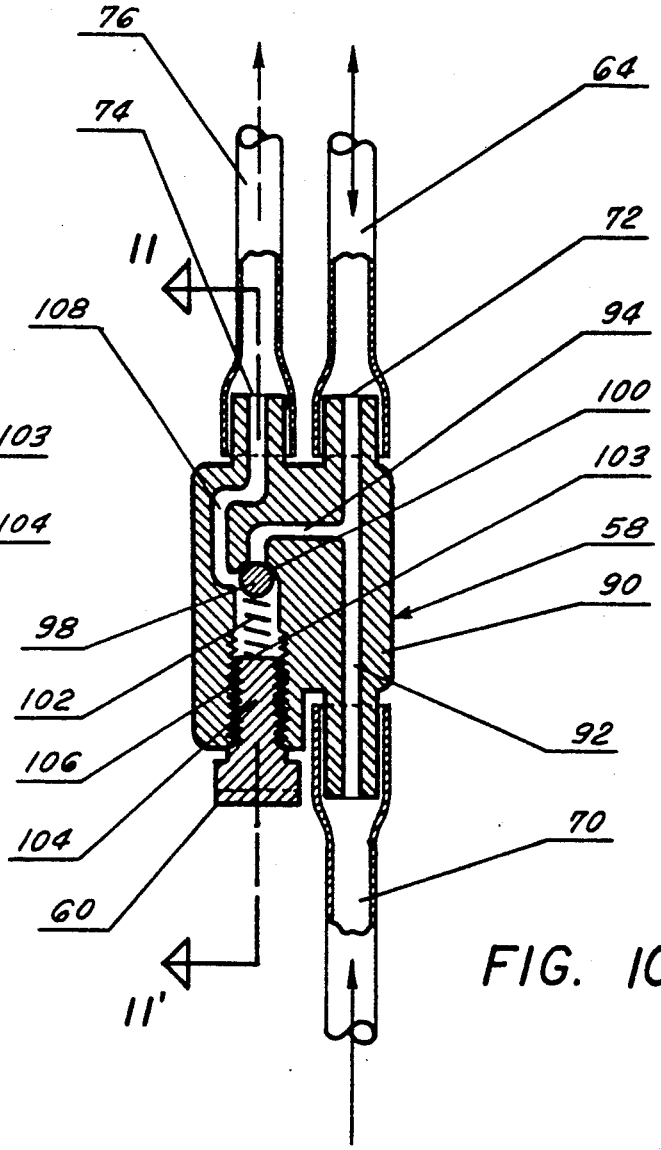
Figure 12:
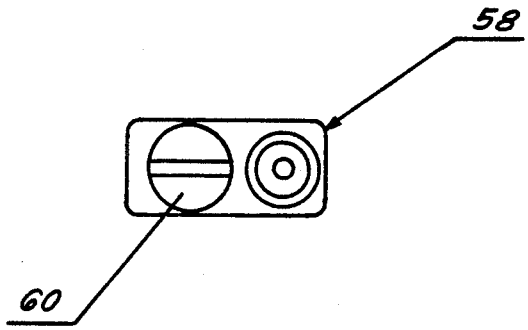

FIGS. 10 through 12 illustrate the pressure control valve 58. The pressure control valve 58 has a housing 90 with a single through longitudinal passage 92 that is intersected by a lateral passage 94 which communicates with a pressure valve. The pressure valve has a ball 98 as its valve member that is seated against a valve seat 100 of the lateral passage 94. The ball 98 is resiliently biased to a normally closed position by a coil spring 102 that has a spring stop 103 on the end of a threadable plug 104 that is received in an internally threaded bore 106 that opens into the lateral passage 94. By threadable adjustment of the plug 104, the tension of the spring 102 which compression the ball 98 against the value seat 100 can be fixedly adjusted, thereby controlling and maintaining a desired degree of pressure required to lift the ball off the valve seat. The internally threaded bore has a discharge passage 108 that communicates upstream of the pressure valve and that discharges through a discharge port 74 into the flexible tube 76.

Figure 13:
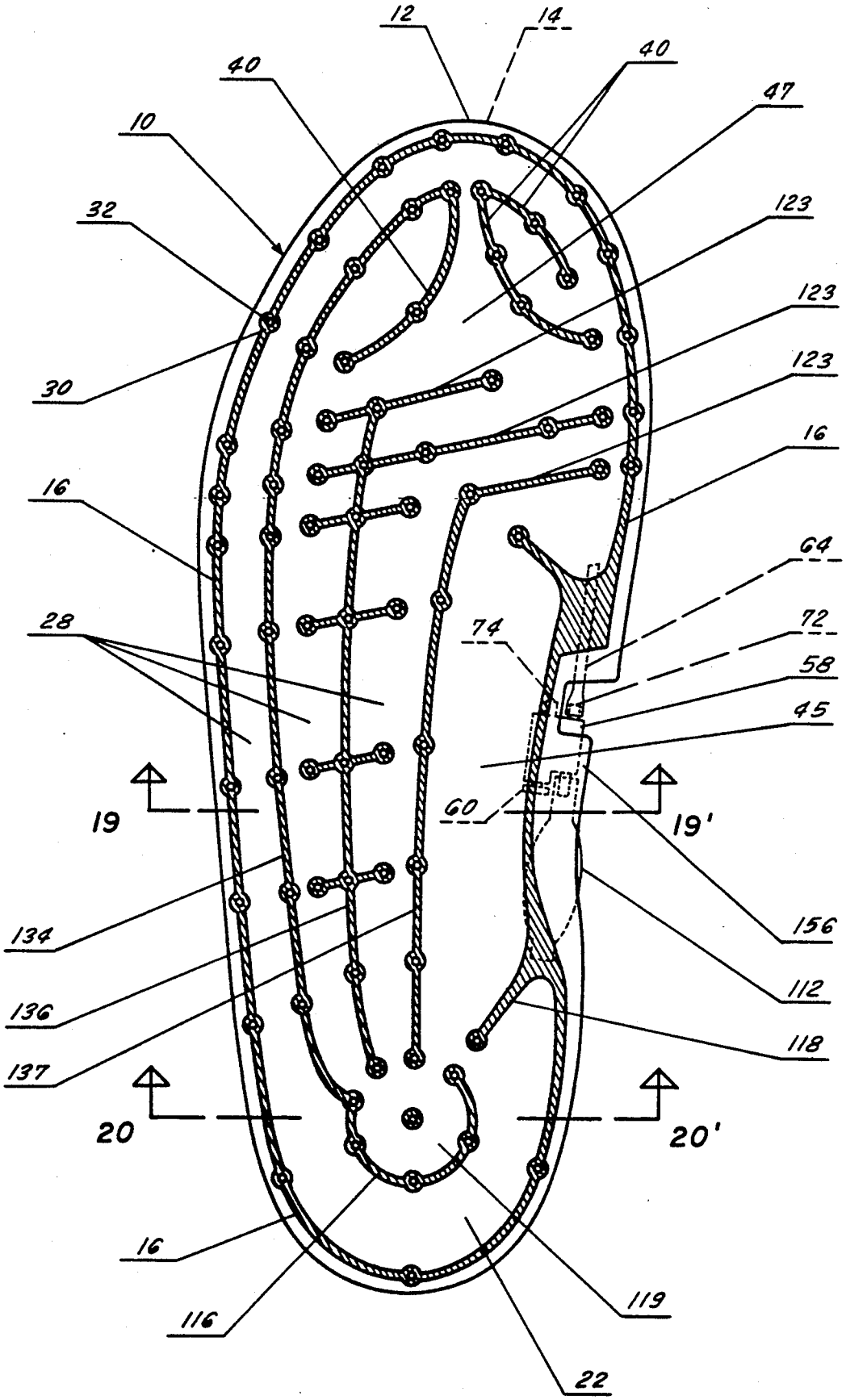
FIG. 13 is a plan view of an alternative inflatable inner sole with a hand pump and pressure relief valve.
Figure 14:
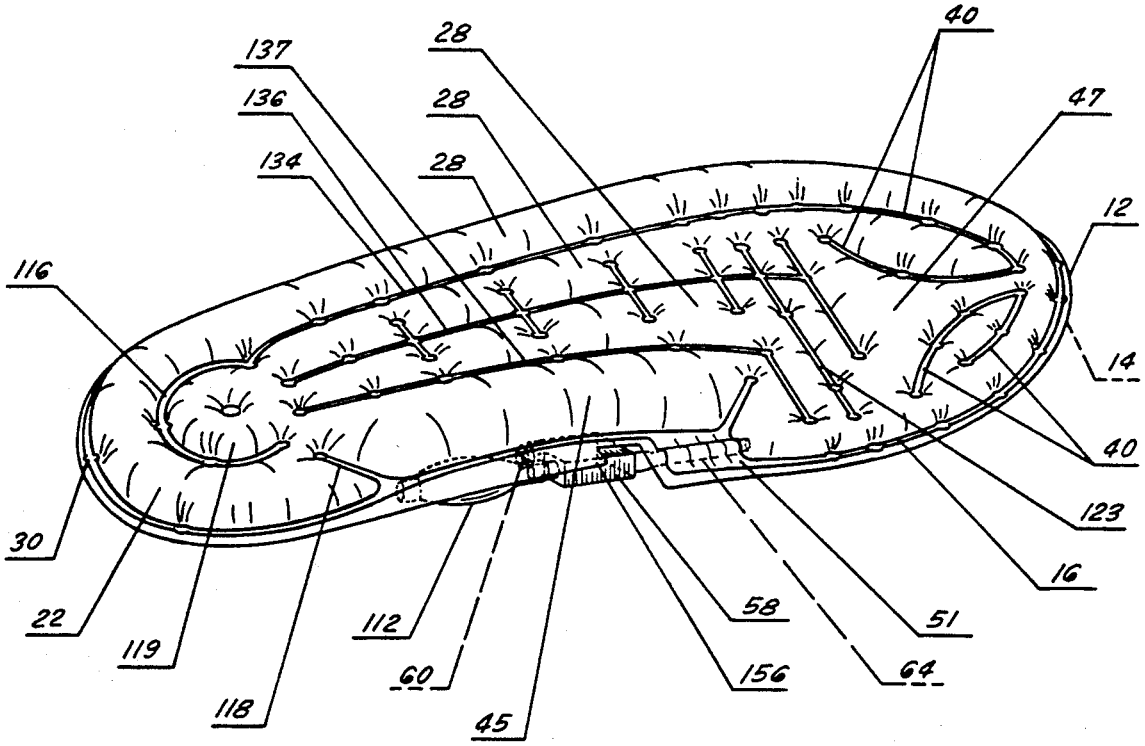
FIG. 14 is a perspective view of the inner sole, hand pump and pressure relief valve shown in FIG. 13.
Figure 20:
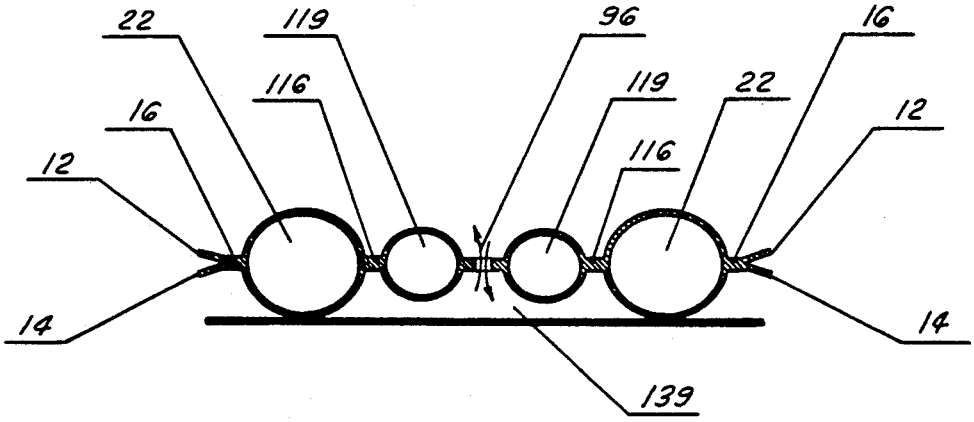
FIG. 20 is a sectional view along line 20—20′ of FIGS. 13, 22 and 29.

Referring now to FIGS. 13 and 14, an alternative embodiment of the inflatable inner sole is shown in plan view. This embodiment is shown in perspective view in FIG. 14. The upper sheet 12 and the lower sheet 14 are bonded together with a continuous peripheral seam 16 extending entirely about these two sheets and forming a sealed interior chamber. A flexible tube 64 is molded in the seam. The flexible tube 64 is connected to a pressure regulation valve 58 and to a manually operated air pump 112. These elements are shown in greater detail in FIGS. 15–18. The air pump 112 is positioned medially of the inner sole 10 in a position where it can be manipulated by hand to permit pressurization of the inflatable inner sole. At this location, the hand pump doesn't contact or abrade the wearer's foot. As with the previous embodiment, the inflatable inner sole shown in FIG. 13 has a plurality of discontinuous seams 134, 136 and 137 that are spaced at preselected locations across its surface. Preferably a first seam 134 extends from the toe, laterally to the heel. At the heel, a semi-circular seam 116 is provided with a medially extending discontinuous seam 118 which extends to the peripheral seam 16, and two additional longitudinal seams 136 and 137 extend from the heel across the instep to the toe of the inner sole. A plurality of transverse seams such as 123 are provided to provide for laterally extending tubular passageways between the first and second sheets. These transverse seams 123 impart a flexing capability to the inner sole 10. An arch pillow 45 and a toe pillow 47 are also provided. Referring to FIG. 20, the enclosed space 139 which lies beneath the seam 116 and tubular passage 119 will collapse when the wearer's weight is placed on the area about seam 116 and will flex into the illustrated configuration when the wearer's weight is removed. The result is that the enclosed space 139 continuously varies in volume during walking, and thus functions as an air blower to induce flow of air down the channels beneath the insole and through the apertures 32.

Figure 15:
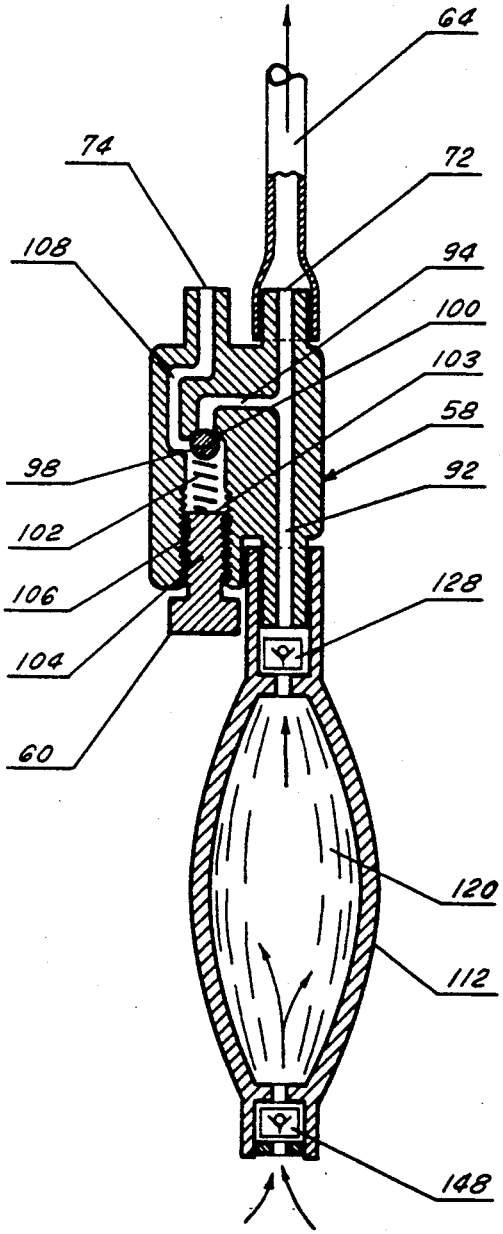
FIG. 15 is a sectional plan view of the air pump used in the embodiment shown in FIG. 13.

Referring now to FIGS. 15 through 18, the subassembly of the pressure regulation valve 58 and air pump 112 will be described. As shown in FIG. 15, the pressure regulation valve 58 is substantially the same as previously described with reference to FIGS. 10–12. The air pump 112, however, is a generally ovaloid, flexible and resilient bulb 120 which is placed laterally against the inside ankle of the wearer of the shoe. At its opposite ends, the air pump 112 is provided with check valves which can be of varied design and configuration.

Figure 16:
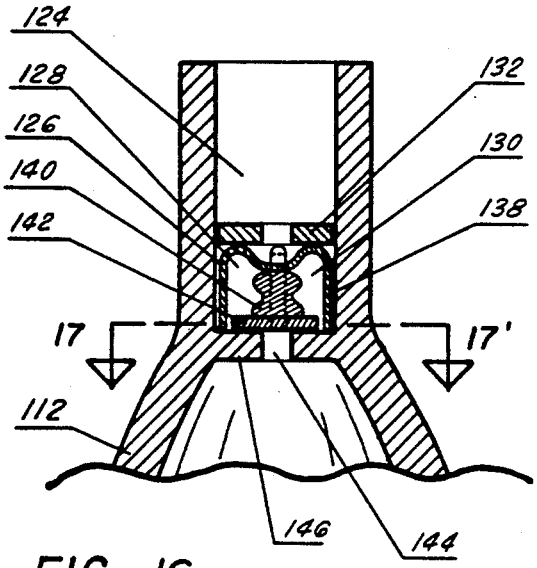
FIGS. 16 and 18 are sectional elevational views of the check valves of the pump of FIG. 15.
Figure 17:
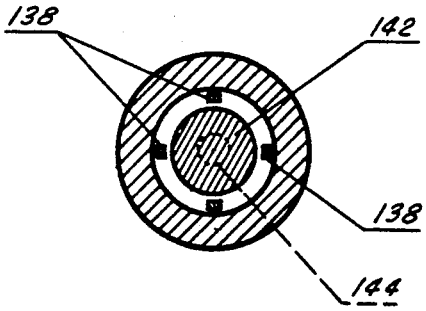
FIG. 17 is a view along line 17—17′ of FIG. 16.

FIG. 16 illustrates a suitable discharge check valve 128 which has a valve chamber 130 formed by a washer 132 placed across the discharge passageway 124 of the air pump 112. A support spider 126 with vertical legs 138 is placed within the chamber 130 and supports at its center a valve member formed by resilient plug 140 and a flat disc 142 that seats against a port 144 in the bottom wall 146 of the valve chamber 130.

Figure 18:
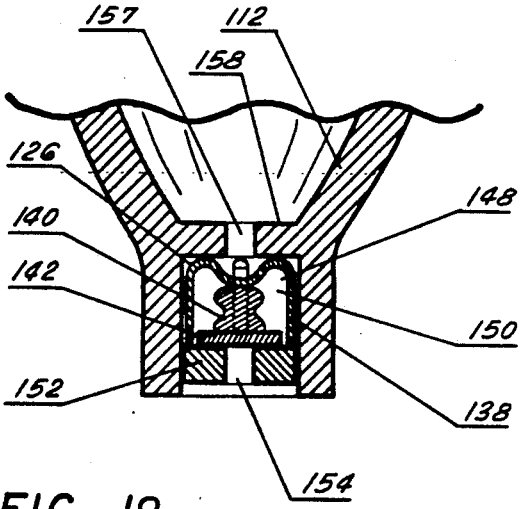

Referring now to FIG. 18, substantially the same valve configuration is used to provide an inlet check valve 148 of the air pump 112. The air pump 112 has an inlet valve chamber 150 with an annular disc 152 which extends across the chamber 150. This disc is fixedly secured within the chamber. A spider member 126 with support legs 138 is provided within the chamber and positions from its center a resilient valve plug 140 with a disc 142 that seats against a port 154 in the annular disc 152 and functions as the valve member of the inlet valve. The bottom wall 158 of the flexible resilient bulb 120 has a port 157 which communicates with the valve chamber 150.

Figure 19:
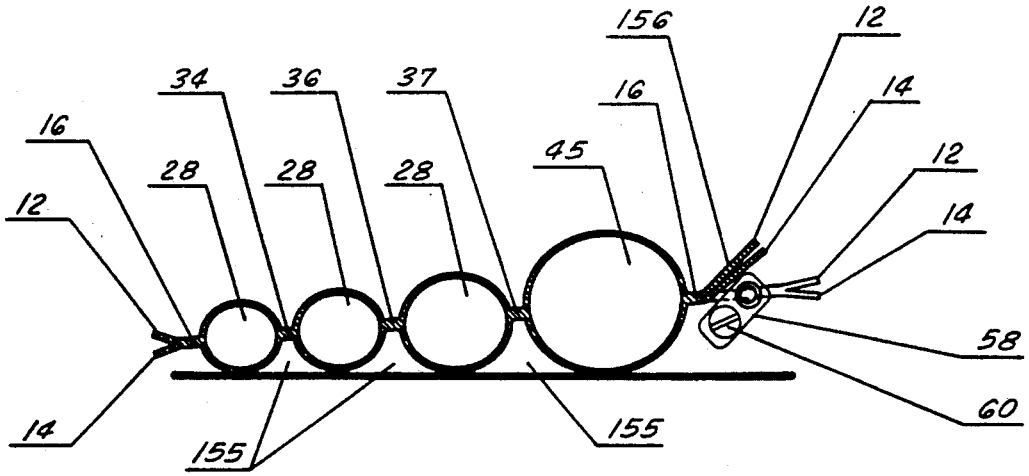
FIG. 19 is a sectional view along line 19—19′ of FIGS. 1 and 13.

As previously mentioned, the various seams between the upper and lower plastic sheet form tubular passageways when the inner sole is inflated. FIG. 19 is a sectional view along line 19—19' of FIGS. 1 and 13, and illustrates the inflated shape or contour of the inner sole. As here illustrated, the peripheral seam 16 secures the upper sheet 12 and lower sheet 14 together while the discontinuous inner seams 34, 36 and 37 form generally tubular passageways 28 and arch pillow 45. As here illustrated, the upper sheet 12 and lower sheet 14 are also shown beyond peripheral seam 16. Also, they could be cut flush with peripheral seam 16, except at the area which forms flap 156. Seam 16 can be made sufficiently wide to provide a seaming or bonding area to secure the inner sole to the footwear.

FIG. 19 also shows that the pressure control valve 58 in the assembly is located beneath an upwardly folded flap 156 of the first and second plastic sheets, thereby avoiding any rubbing contact between the valve 58 and the wearer's foot. Also, the valve could be increased by a soft fabric or sponge layer (not shown). Also, as previously mentioned, the seams form coextensive channels 155 which are indented into the undersurface of the inner sole 10. These channels 155 interconnect in a communicating network on the pattern of the seams shown in FIGS. 1 or 13. This network forms a distributor for forced air circulation in a shoe fitted with the inner sole 10.

FIG. 20 is a sectional view along line 20—20' of FIGS. 13. 22 and 29. As there illustrated, the semi-circular seam 116 forms an annular tubular passage 119 and 22 of substantial dimensions at the heel. As previously mentioned, apertures 32 are provided through the seams between the upper and lower sheets at various locations and air and/or moisture passes through the apertures as shown by the arrowhead lines 96.

Figure 21:
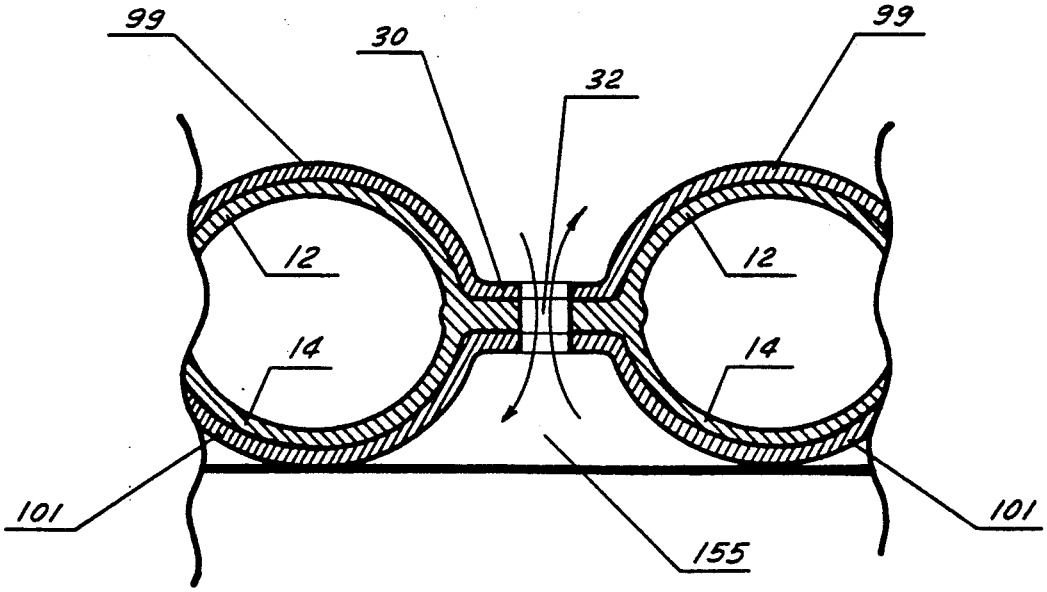
FIG. 21 is an enlarged sectional view through an aperture of an alternative embodiment having a lining about the inner sole.

FIG. 21 is a sectional view through a typical aperture 32. The seam between the upper sheet 12 and lower sheet 14 welds these sheets into a homogeneous band. In a preferred embodiment, the sheets 12 and 14 can be covered by outer layers 99 and 101 of fabric, plastic foam, etc., to enhance the comfort of the inner sole 10. Also, if desired, the outer layer 101 can be an insulation layer, e.g., a reflective insulating film such as a film of polypropylene between aluminum foil sheets specially for boot liner FIG. 30 to keep heat inside the liner.

Figure 22:
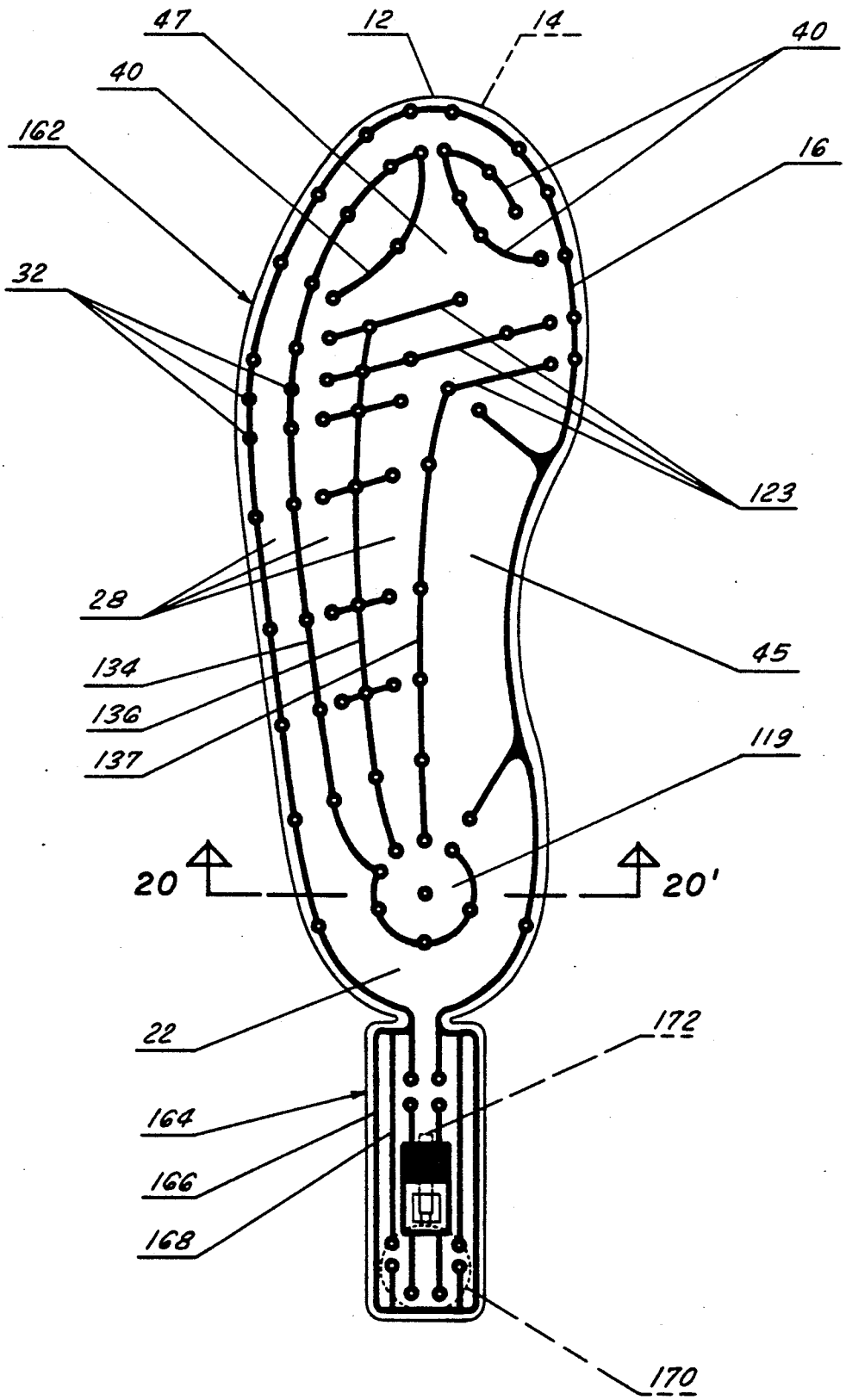
FIG. 22 is a plan view of an alternative inflatable inner sole having an inflatable side tab at its heel.

Referring now to FIG. 22, there is illustrated an inflatable inner sole 162 which has substantially the same construction as that previously described with reference to FIG. 13, however, this inflatable inner sole also has a side tab 164 at its heel. The tab 164 is folded flat and shown in plan view. As there illustrated, both the upper and lower plastic sheets are provided with rearwardly extending generally rectangular shaped tabs that are sealed together with a peripheral continuous seam 166 that is preferably continuous with the peripheral seam 16 about the inner sole. Additionally, a plurality of longitudinal seams 168 are provided within the side tab 164 to provide a plurality of internal passageways therein and thin tab 164. These seams are closely spaced to provide thin or narrow passageways so that the thickness of the inflated tab will not be excessive. The side tab 164 also supports the air pump 170 generally indicated by the broken lines which discharges through a flexible tube 172. Tube 172 is permanently secured in tab 164.

Figure 24:
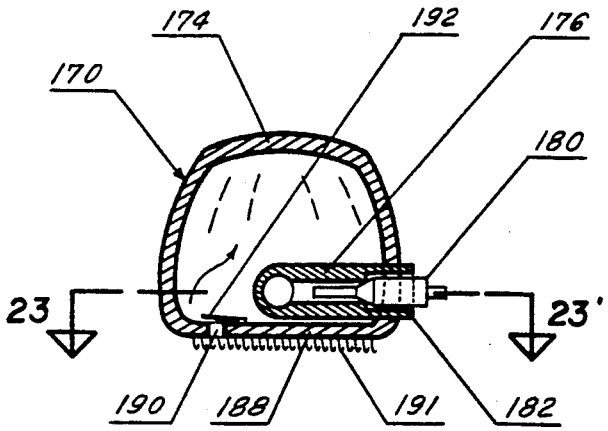
FIG. 24 is a sectional elevational view along line 24—24′ of FIG. 23.
Figure 25:
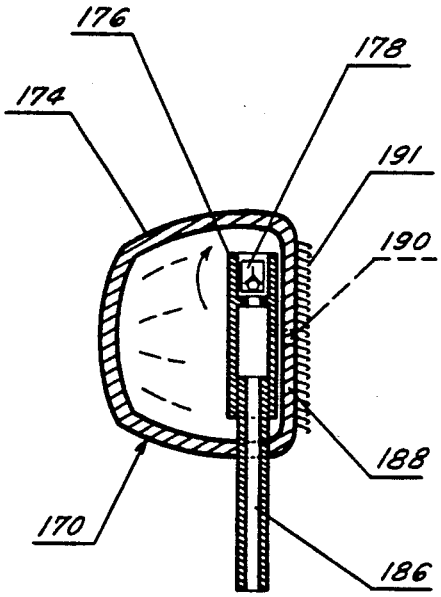
FIG. 25 is a sectional elevational view along line 25-25′ of FIG. 23.
Figure 23:
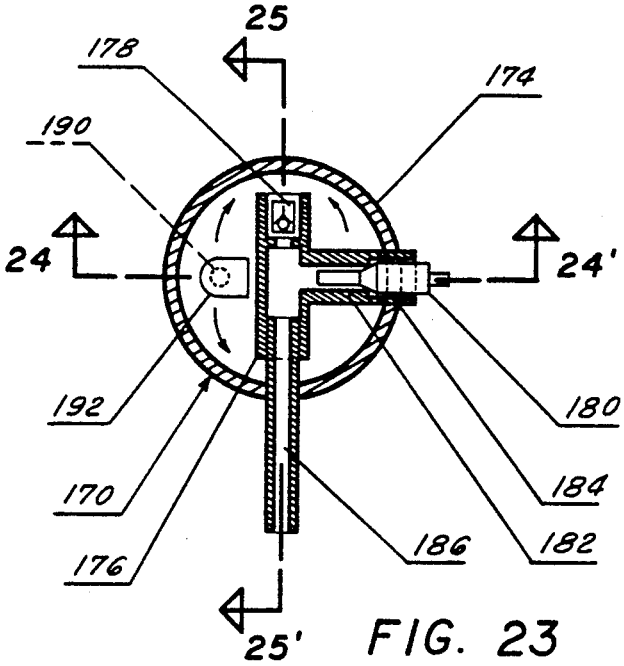
FIG. 23 is a sectional plan view along line 23—23′ of FIG. 24, showing the hand pump used in the alternative inflatable inner sole of FIGS. 22, 29 and 30.

The air pump 170 which is used in the embodiment of FIG. 22 is generally illustrated in sectional views in FIGS. 23 through 25. FIG. 23 is a plan view of the air pump and shows a generally circular flexible bulb 174 which has a tubular tee 176 internally received within the bulb 174. Tee 176 contains the discharge check valve 178 and the release valve 180 for the pump. The base leg 182 of the tee 176 extends through the sidewall 184 of the bulb 174 of the pump and receives a conventional pressure release valve 180 such as available commercially as a tire valve core part No. 7595, from Schrader Automotive, Inc. Nashville, Tenn. The other end of the tee 176 is internally contained in the bulb 170 and houses a small check valve 178 that is directed to prevent fluid flow into the bulb 170. This valve receives air from the bulb 170 and discharges the air into the tee 176 for passage through the flexible tube 172 to the inflatable inner sole. Preferably, a Velcro band 191 is attached to the undersurface of wall 188 to secure the pump to tab 164.

The third end of the tee 176 receives tube 186 which connects to flexible tube 172, previously described. The bottom wall 188 of the bulb 174 also has an inlet port in the form of an aperture 190 with a flapper valve 192 hinged along one side on its internal bottom surface to serve as the inlet valve.

Figure 26:
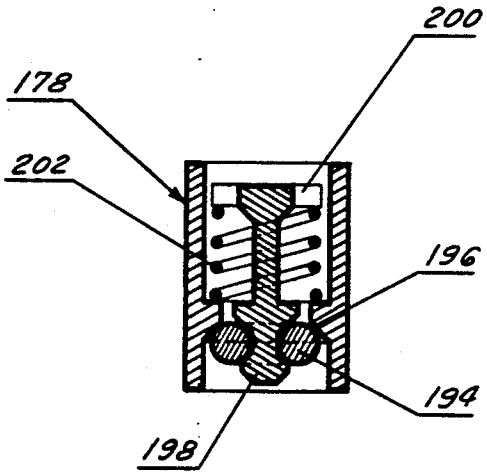
FIGS. 26 and 27 are sectional views through the check valves used in the pump of FIGS. 23-25.
Figure 27:
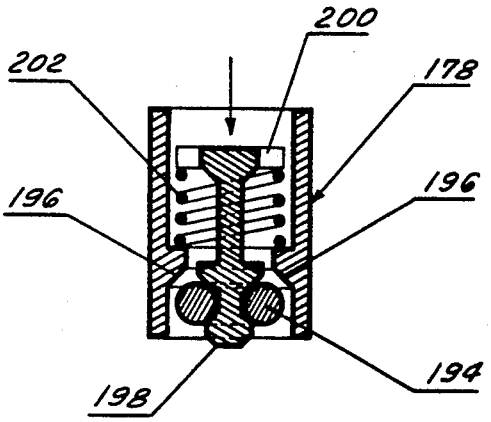

The check valve 178 used for the air pump are shown in FIGS. 26 and 27. In FIG. 26, the check valve 178 is shown in its closed position with the valve member in the form of an O-ring 194 being resiliently biased against the valve seat 196 by the valve stem 198 that is dependent at its upper end from a disc 200 that serves as a retainer to capture the compression coil spring 202 between the retainer and the bottom surface of the valve chamber. When the air is discharged into the tee 176, the air dislodges the valve member against the tension of resilient spring 202, permitting air to flow into the tee 176 and through the flexible tube 172 to the inflatable inner sole, as shown in FIG. 27.

Figure 28:
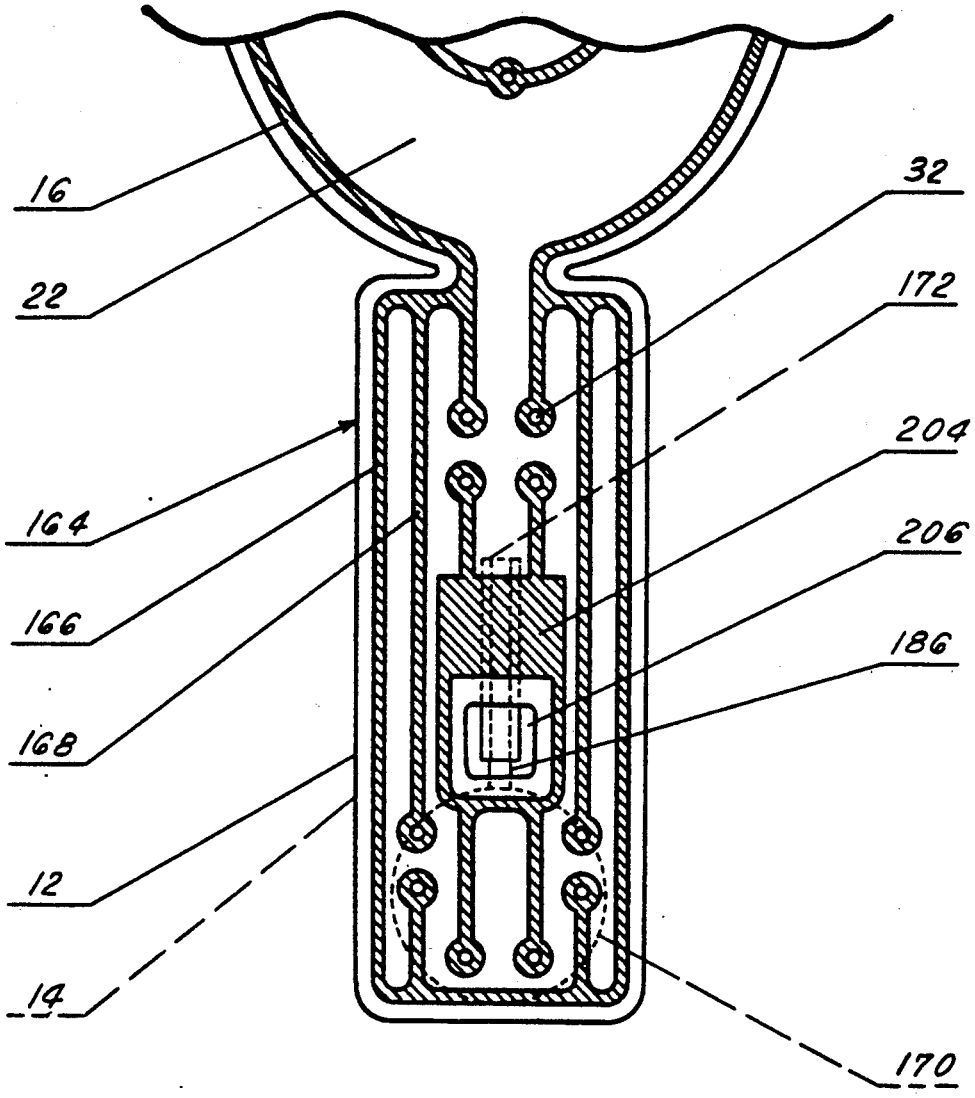
FIG. 28 is an enlarged sectional plan view of the inflatable side tab located at the heel of the inflatable inner sole shown in FIG. 22.

Referring now to FIG. 28, there is illustrated an enlarged view of the side tab 164 of the inner sole. The flexible discharge tube 172 extends through a center seamed area 204 which is sufficiently large to provide security and support for the tube and the assembly of the air pump 170 shown in FIGS. 23 through 25. The air pump 170 is shown by the broken line. An opening 206 through tab 164 provides access to permit securing the pump 170 to the flexible tube 172. This mounting also biases the flexible resilient bulb of air pump 170 against the tab 164.

Figure 29:
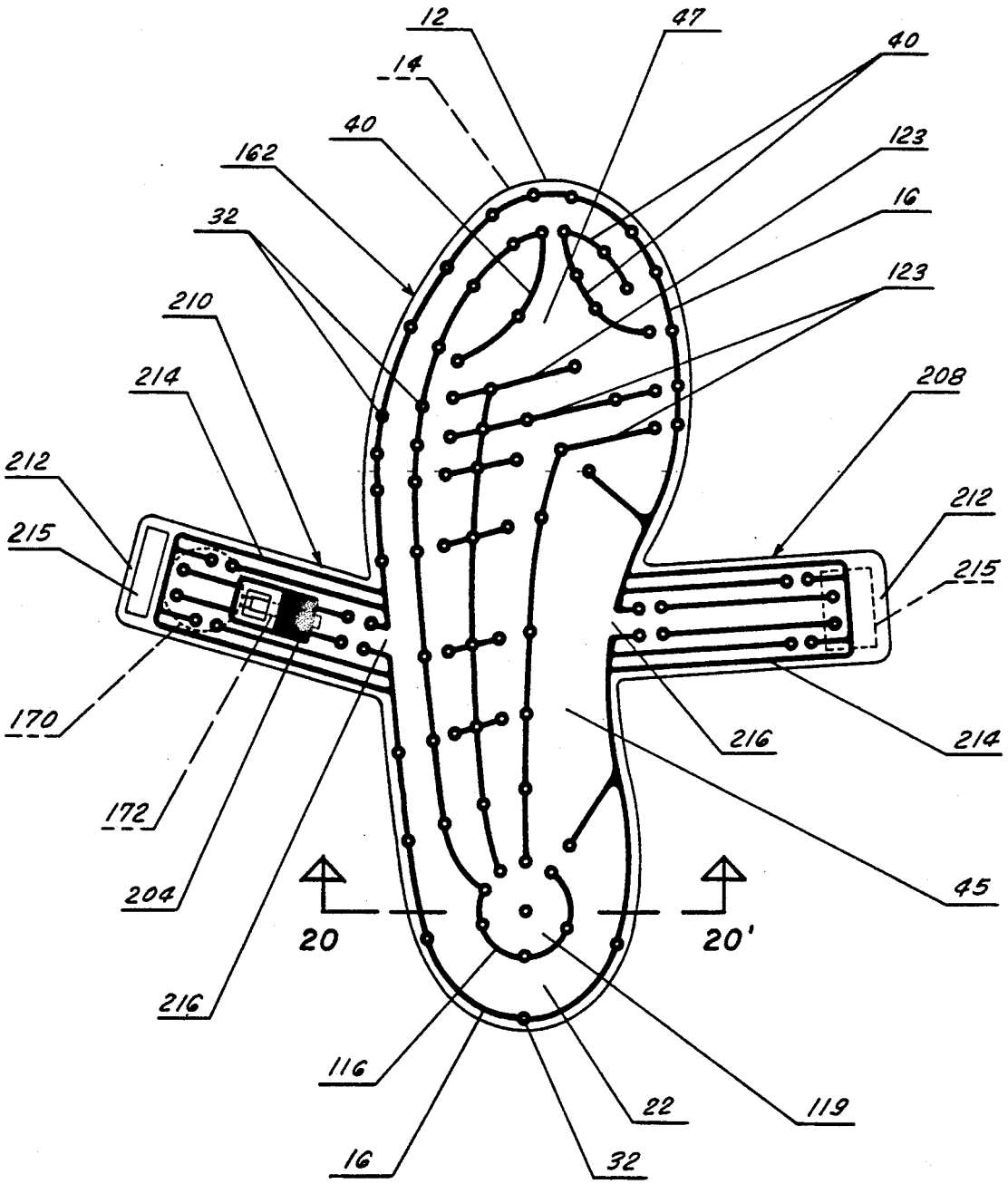
FIG. 29 is a plan view of an alternative inflatable inner sole with medial and lateral inflatable tabs which fold over the instep of the shoe.

The inflatable inner sole 10, alternatively, be provided with one or more side tabs such as the medial side tab 208 and the lateral side tab 210 shown in FIG. 29. Preferably these side tabs are of sufficient length and are located at the instep to permit folding over the instep of a wearer's foot and these side flaps can be attached together, preferably by providing bands 212 which carry hook-fabric attachments 215 such as Velcro, at each of their ends so that they will be fastened together when folded over the wearer's foot. Each of the side tabs is provided with a peripheral seam 214 that forms a sealed interior which communicates through an opening 216 in the peripheral seam 16 of the inflatable inner sole whereby the side tabs 208 and 210 are also inflated. The inner sole can be secured to the footwear by stitching or cementing seam 16 to the inside sole of the footwear and, where appropriate, to the inside of the uppers of the footwear.

One side tab, 210, carries the air pump 170 shown in broken line. The pump is previously described with reference to FIGS. 23 through 25. The pump discharges into a flexible tube 172 that is also secured within a central sealed area 204 between the upper and lower plastic sheets. Preferably, the air pump is located at the instep area of the shoe where the air pump will be readily accessible for hand operation. For this application, an opening can be provided on the upper part of the outer shoe.

Figure 30:
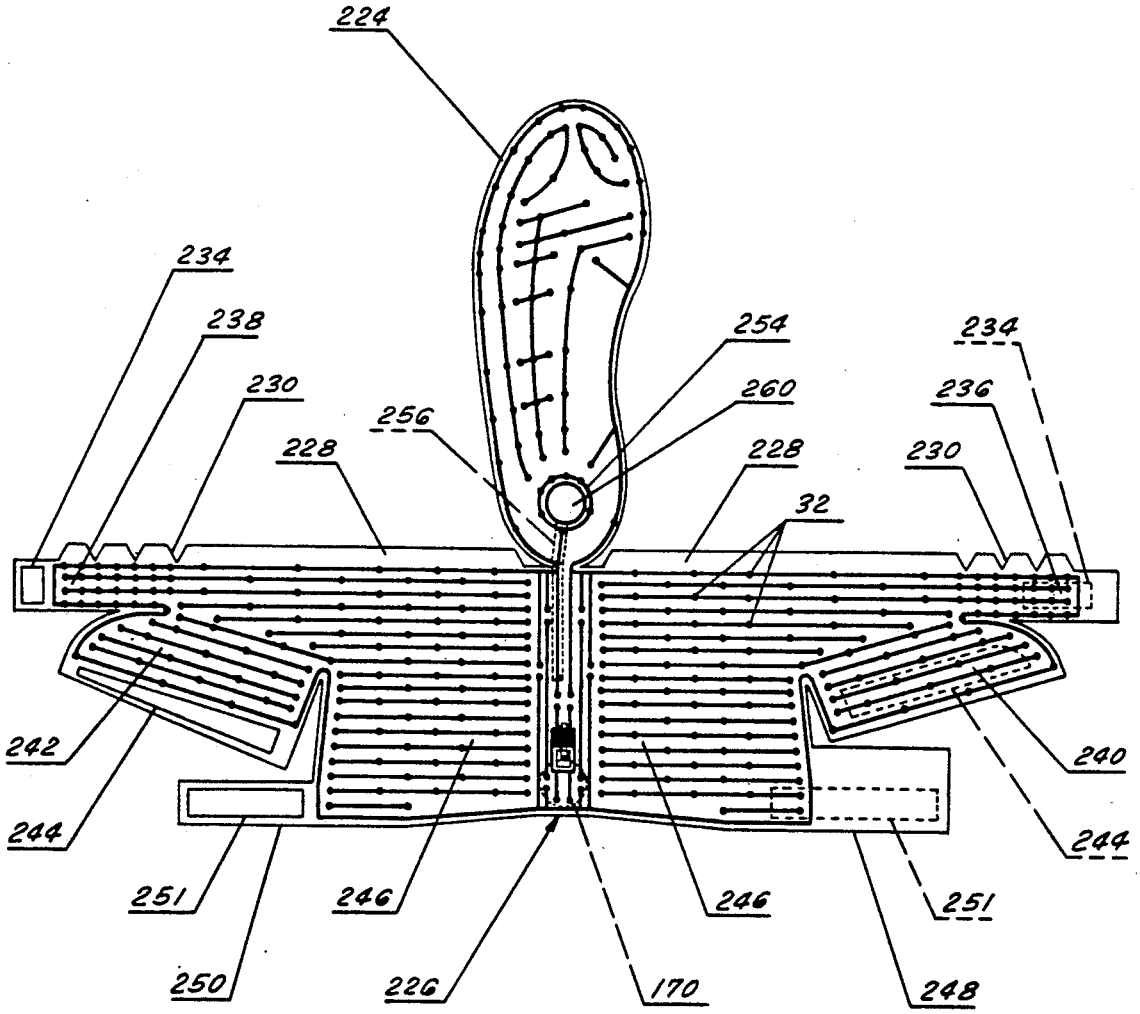
FIG. 30 is an inflatable boot liner which has an air pressurization and forced air circulation system.

Referring now to FIG. 30, there is illustrated an inflatable inner sole 224 which is integral with an inflatable liner for the entire upper region of a boot. The inner sole 224 is shown in a simplified view, it could include all the elements and features previously described. For this purpose, the inner sole 224 has, at the rear of its heel portion, an integral flap 226 that extends laterally and medially a sufficient distance to permit the flap 226, when folded vertically to extend entirely about the toe of the inner sole. Preferably this large flap forms a liner for the upper of the boot. The flap 226 has a coextensive tab 228 which can fold beneath the inner sole and also can be glued to the inner sole. As the tab must be formed about the curved toe, this co-extensive tab can have a plurality of V-shaped notches 230 to permit folding about this curved surface without forming creases. The vertical flap 226 is provided with a plurality of fabric attachment bands 234 such as Velcro to secure its opposite ends 236 and 238. Thus, a band of Velcro is provided at the medial end 236 of flap 226, and a co-acting Velcro band is placed on the opposite side of the flap 226 on its lateral end 238, thereby permitting the ends of the flap 226 to be secured together when wrapped about the toe of the inner sole. Preferably flaps 240 and 242 are provided at the medial and lateral sides of the instep to fit over the instep of the boot and each of these flaps also is provided with a co-extensive Velcro band 244 on its opposite sides whereby the flaps can be folded over the instep of the wearer and secured together with the bands of Velcro attachment fabric. The upper portion of the ankle area 246 of the flap 226 also preferably has medial and lateral extending tabs 248 and 250 which carry co-extensive Velcro bands 251, again on opposite sides to permit securing of these tabs about the ankle of the wearer.

An air pump 170 is provided in the flap 226 and this air pump is shown by the broken lines similar to that shown on FIGS. 23 through 25 and mounted similarly to the mountings shown in FIGS. 22 and 29. In addition, the heel of the inner sole preferably includes a continuous circular seam 254 to form an opening that will receive an air blower 260 which induces forced air circulation through the shoe. The air inlet to the blower is flexible tube 256 which extends along tab 226 and is shown in a broken line in FIG. 30.

Figure 31:
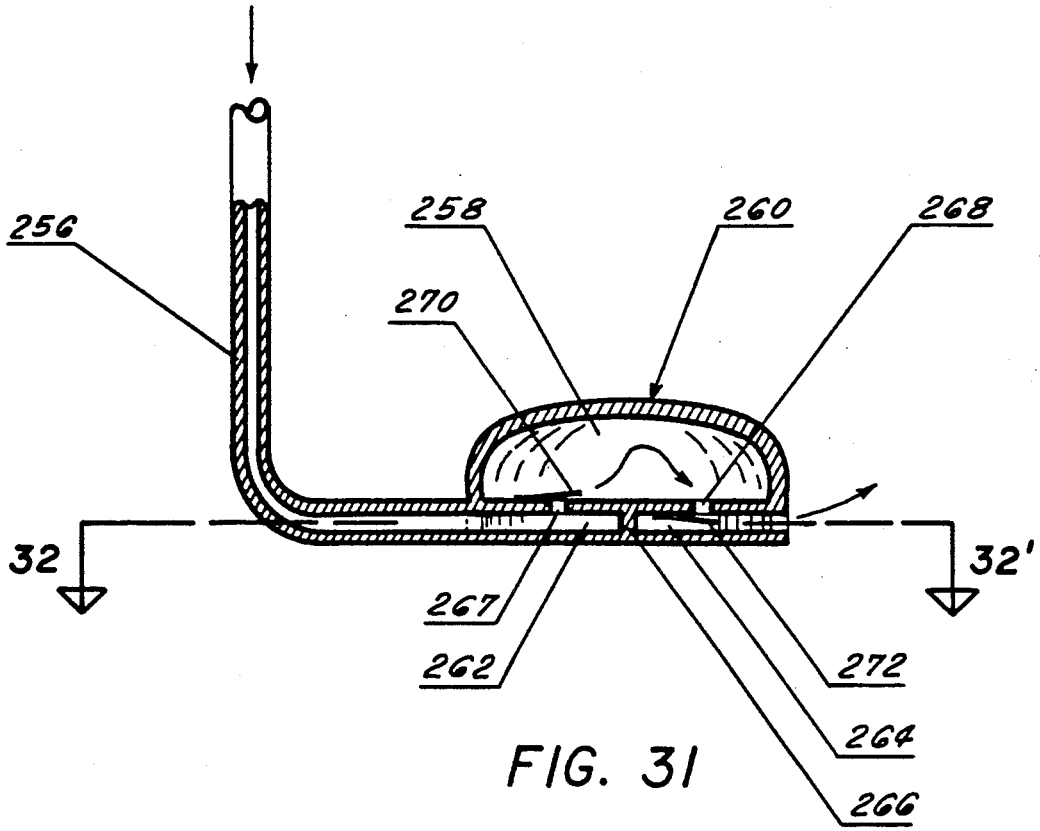
FIG. 31 is an enlarged sectional elevational view along line 31—31′ of FIG. 32 showing a blower to circulate air in the boot liner of FIG. 30.
Figure 32:
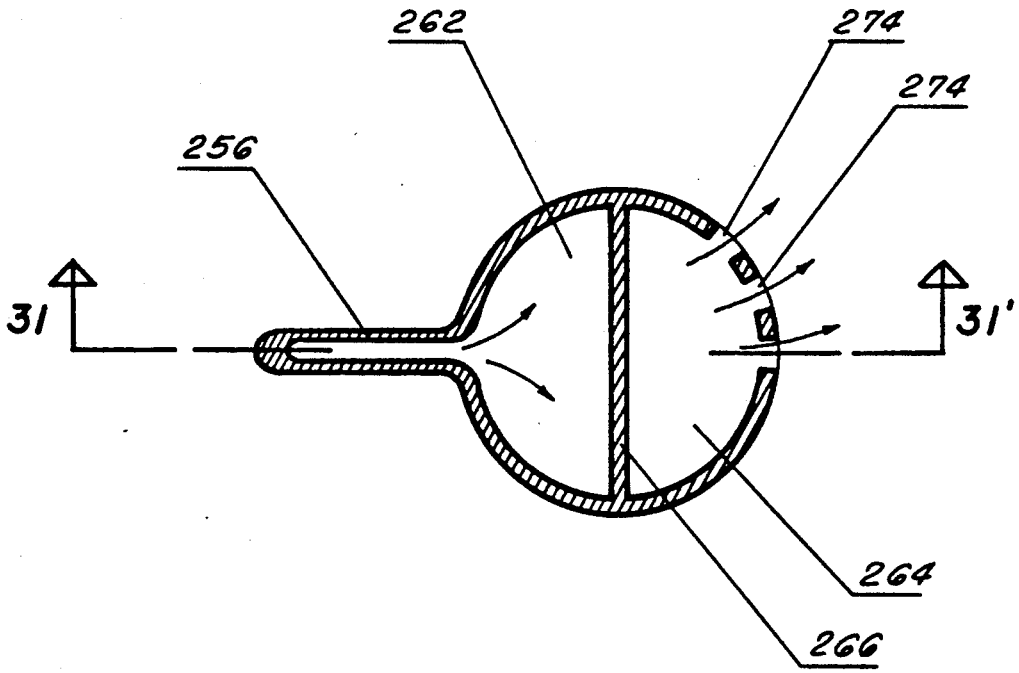
FIG. 32 is a sectional view along line 32—32′ of FIG. 31.

The blower is shown in greater detail in FIGS. 31 and 32, and includes the aforementioned flexible tube 256 for the fresh air inlet that communicates with an inlet chamber 262, an upper chamber 258 within the flexible bulb 260 of the blower, and outlet chamber 264. Inlet chamber 262 and outlet chamber 264 are separated by a transverse wall 266. Apertures 267 and 268 are provided, one each in the top wall of each subjacent chamber 262 and 264, opening into the chamber 258 of the flexible and resilient bulb 260 of the air blower. A flap 270 of flexible plastic sheet material is mounted over the aperture 267 communicating with the inlet chamber 262 and is hinged to the bottom surface of the flexible bulb to thereby function as an inlet flapper check valve. A similar flap 272 of flexible sheet material is mounted on the undersurface of the bottom wall of the flexible bulb to function as a discharge flapper check valve.

As shown in FIG. 32, preferably a plurality of apertures 274 are provided about the periphery of the outlet chamber 264 to permit air to be discharged into the shoe, beneath the inner sole thereby serving to force air down the channels which are formed between the tubular passageways of the inflatable inner sole thereby permitting the air to be circulated through the plurality of through apertures of the inner sole thereby establishing forced air circulation through the shoe above and below the inner sole.

The inflatable inner sole shown in FIGS. 33–39 is substantially similar to that shown in FIG. 1, however, a greater number of seams 25 are provided, which decreases the diameters of the air channels 21 which are formed between the seams, thereby reducing the thickness of the inner sole. This is desirable to permit use of the inner sole with existing footwear, as it can be easily inserted or removed from existing footwear. This effect is apparent in the sectional view which appears as FIG. 34. In this embodiment, the peripheral channel 20 is slightly larger than the other channels 21 to provide greater stability and gripping.

Figure 35:
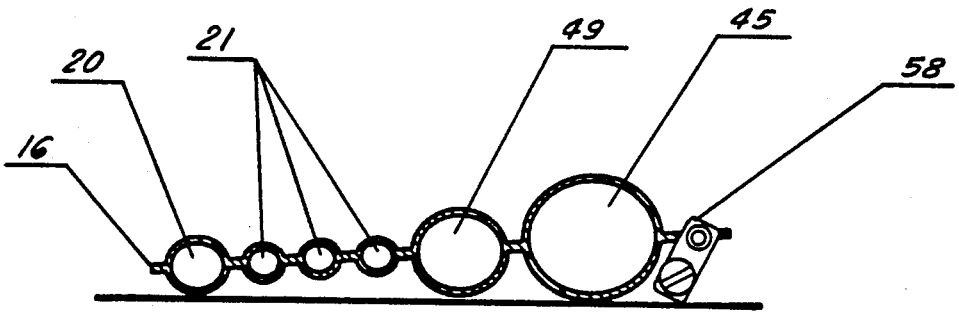
FIG. 35 is a sectional view along line 35—35′ of FIG. 33.

Referring now to FIG. 35, the sectional view through the instep of the inner sole shows channels 45 and 49, which provide large pillows that give arch support to the wearer.

Figure 33:
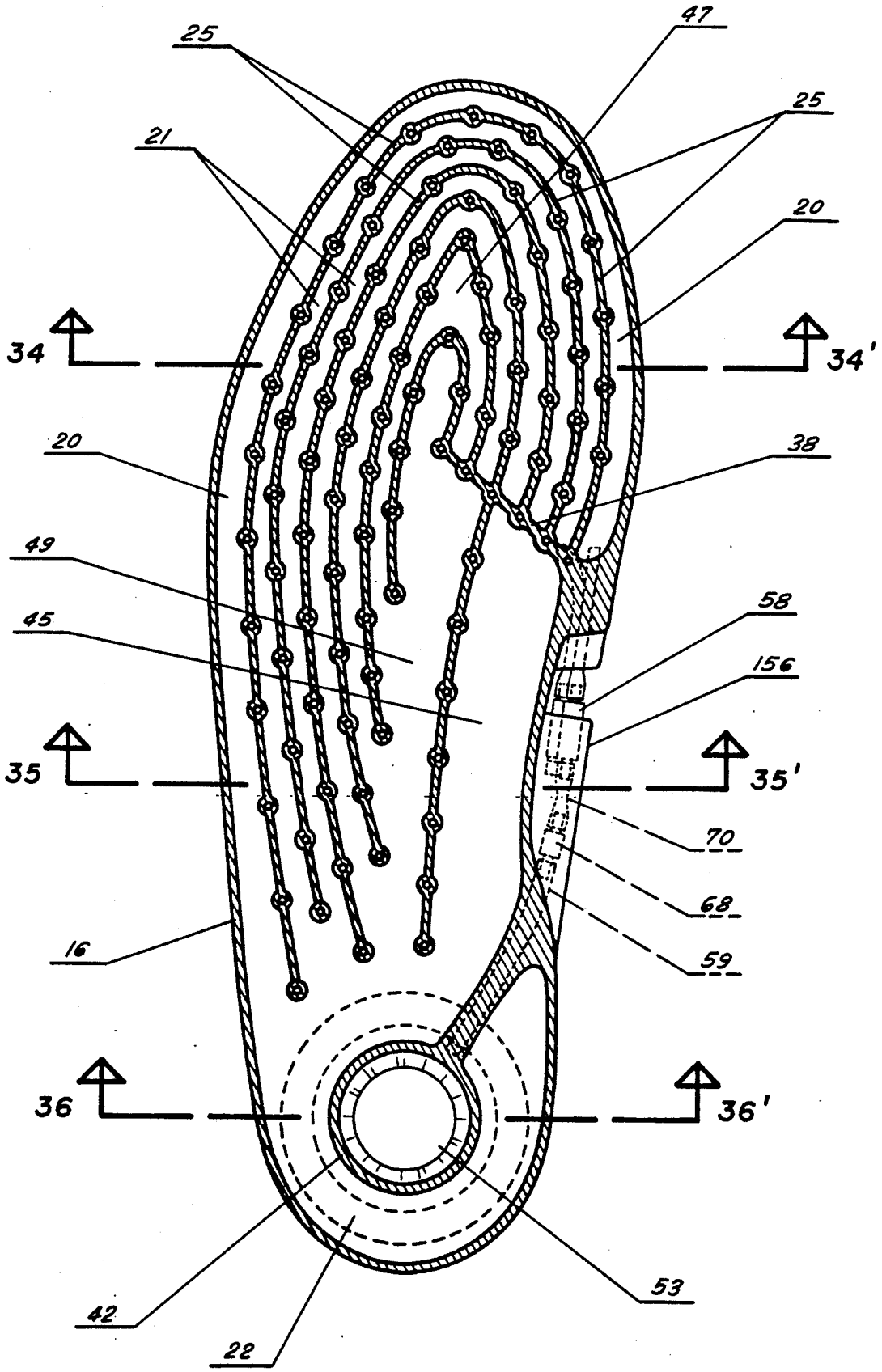
FIG. 33 is a plan view of an alternative inflatable inner sole.
Figure 34:
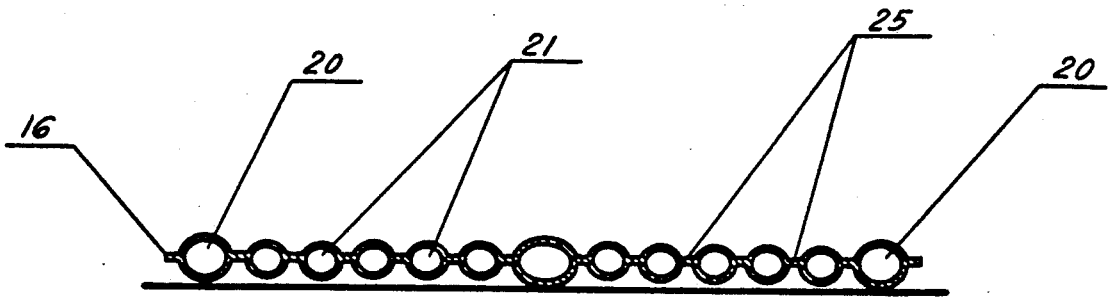
FIG. 34 is a sectional view along line 34—34′ of FIG. 33.
Figure 36:
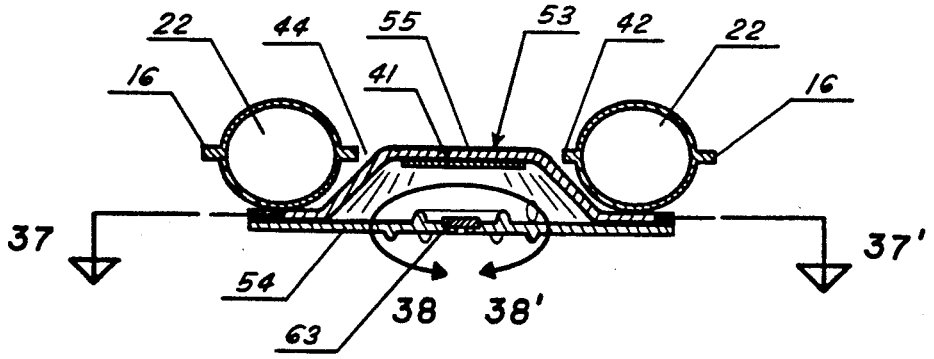
FIG. 36 is a sectional view along line 36—36′ of FIG. 33.
Figure 37:
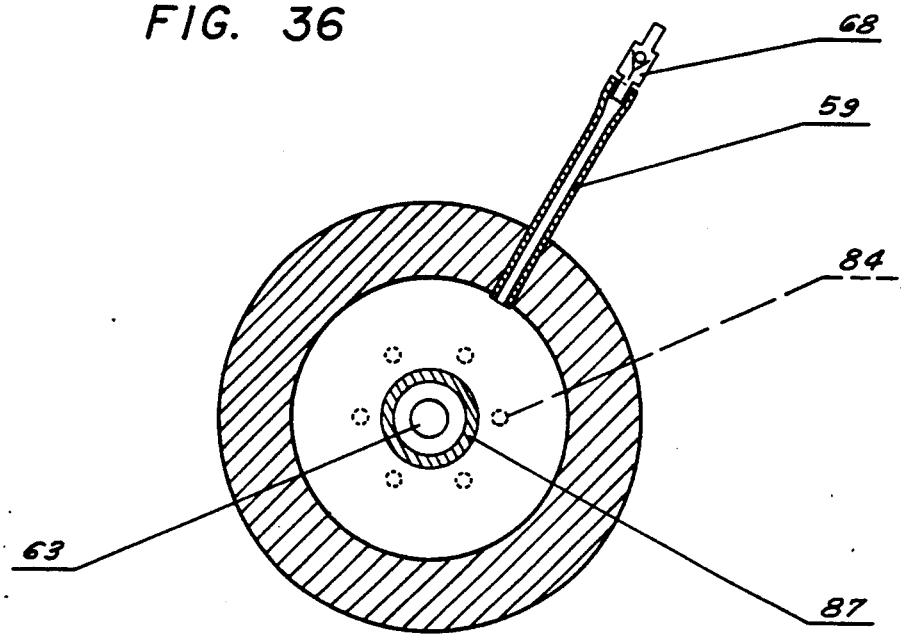
FIG. 37 is a sectional view along line 37—37′ of FIG. 36.

FIG. 36 is a sectional view through the internal inflation pump 53 of the inflatable inner sole shown in FIG. 33. The pump 53 is an expandable chamber pump, and fits within the well or recess formed by circular seam 42 which surrounds aperture 44 through the sheet materials from which the inner sole is manufactured. This pump 53 is retained beneath the aperture as its diameter is greater than that of the aperture 44. The pump 53 is similar to pump 50, previously described with reference to FIGS. 6 and 7 and has a plurality of protrusions 84 on its undersurface to provide a clearance for air passage. The pump 53 is formed with a bottom sheet 54 to which is bonded the upper sheet 55. Preferably the bottom sheet has a substantial diameter to provide an annular flat seam which has sufficient width (see FIG. 39) to prevent extruding through the aperture 44 of the inner sole. A flexible tube 59 communicates with the air pump 53 and passes to the check valve 68 and pressure control valve 58, shown in FIGS. 33 and 39. An aperture 61 (see FIG. 38) in the side wall of pump 53 opens into tube 59. These elements are described in detail with reference to the same elements of FIG. 1.

Figure 38:
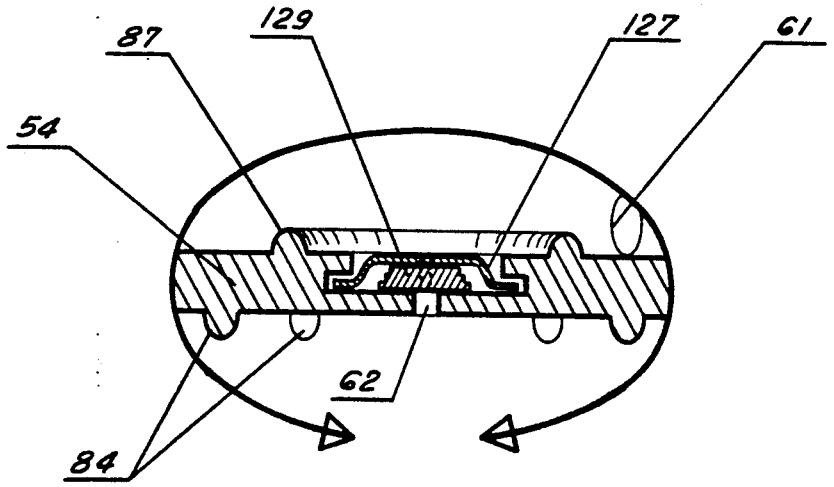
FIG. 38 is an enlarged view of the area within the line 38—38′ of FIG. 36.
Figure 39:
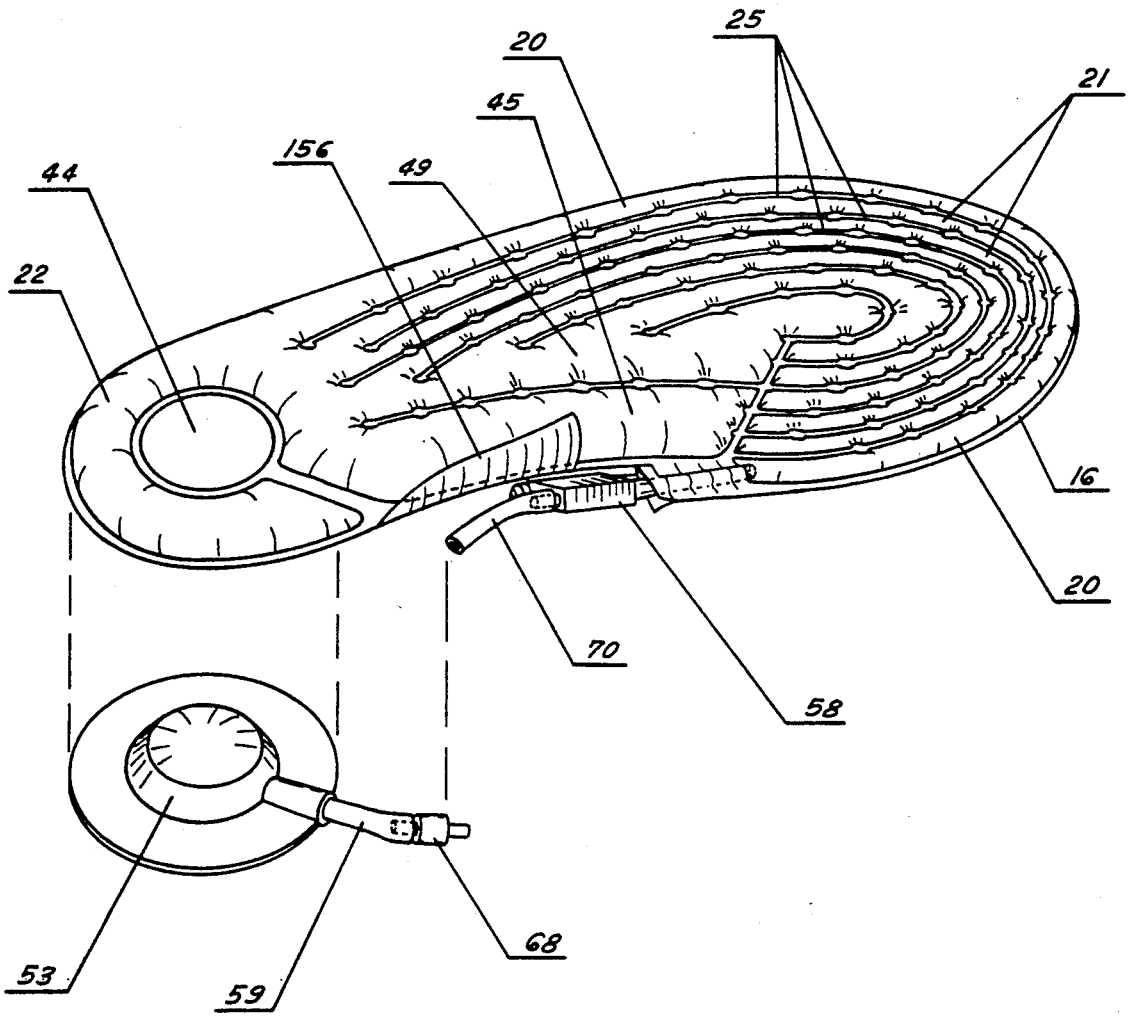
FIG. 39 is a perspective view of the inflatable inner sole shown in FIG. 33.
Figure 40:
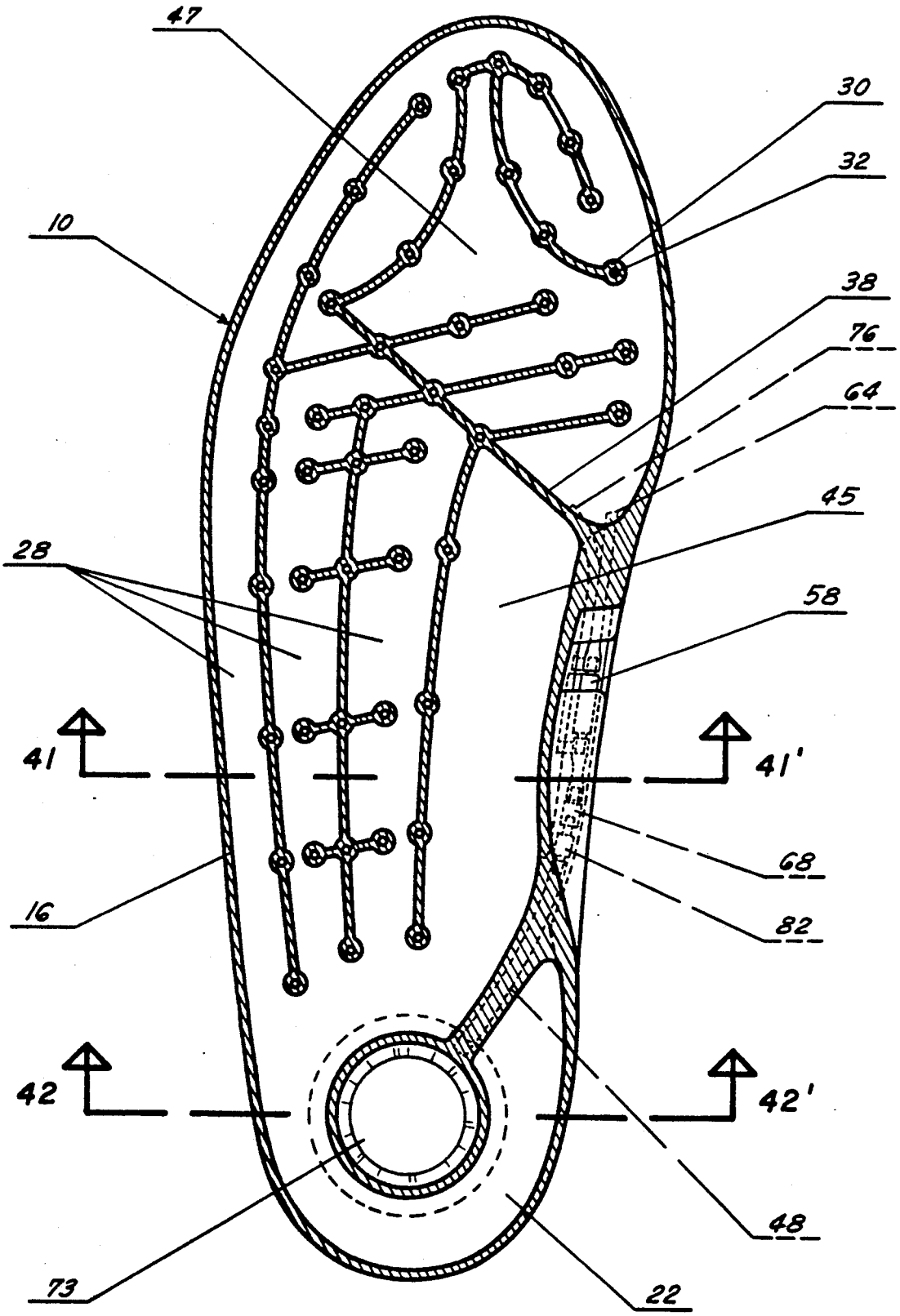
FIG. 40 is a plan view of an alternative inflatable inner sole.

The inlet valve to the air pump 53 is shown in detail in the enlarged sectional view of FIG. 38. As there illustrated, the bottom wall 54 of the air pump has an aperture 62 which is closed by the resilient plug 129 that is supported by spider 127. When a partial vacuum is formed within the pump 53, by expansion of the chamber of the pump, air flows past valve plug 129 and into the chamber of the pump. When the wearer's heel compresses the pump 53, the plug 129 seals the aperture 62 and forces the air through tube 59 and check valve 68. Preferably, the valve structure is surrounded by a raised circular rib 87 to prevent damage to the spider 127 and plug 129 when the air pump is entirely compressed. Preferably, a plate 41 is placed beneath the upper surface of the pump 53 to reinforce and stiffen this surface.

The plug 129 also functions to seal the inlet aperture against water intrusion, particularly when the inner sole, or footwear with the inflatable sole is washed or cleaned. Water cannot intrude past the plug 129 as there is no partial vacuum developed within the air pump 53.

Figure 41:
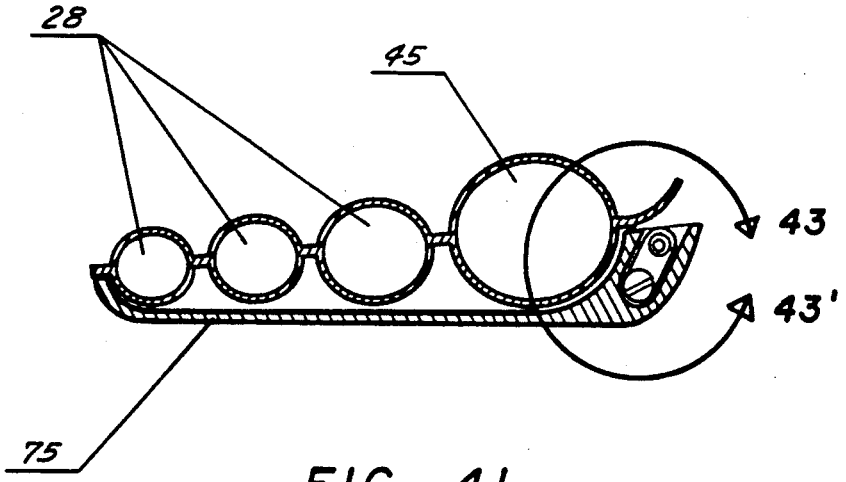
FIG. 41 is a sectional view along line 41—41′ of FIG. 40.
Figure 42:
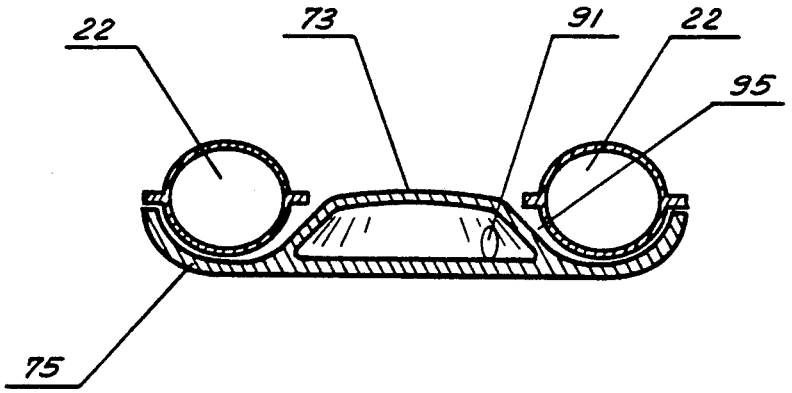
FIG. 42 is a sectional view along line 42—42′ of FIG. 40.
Figure 43:
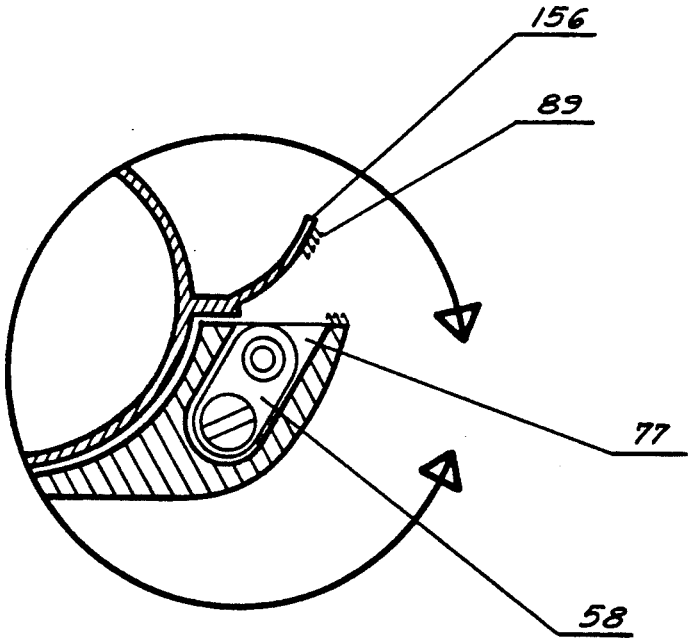
FIG. 43 is a an enlarged view of the area within the line 43—43′ of FIG. 41.
Figure 44:
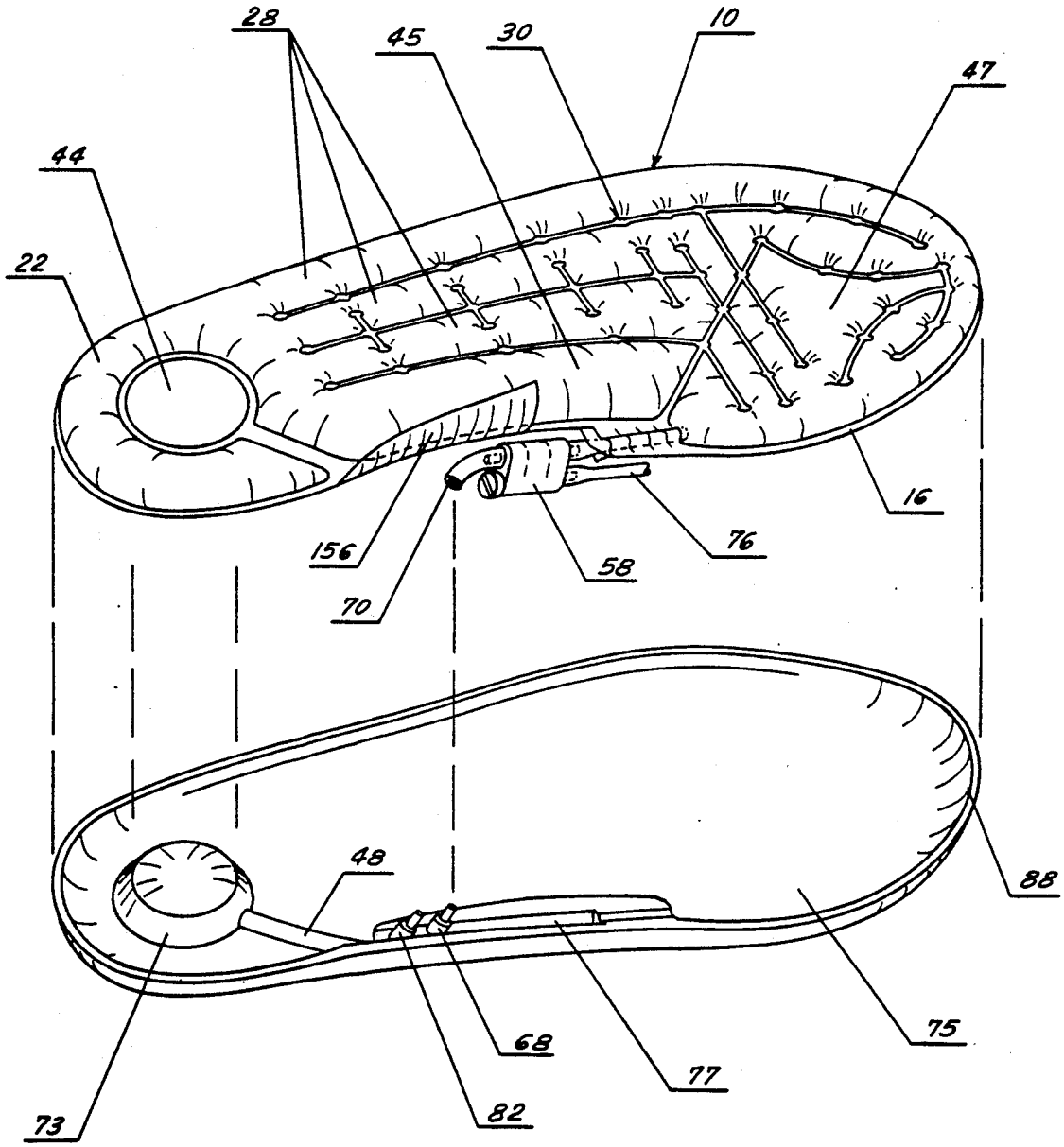
FIG. 44 is an exploded perspective view of the inflatable inner sole of FIG. 40.
Figure 45:
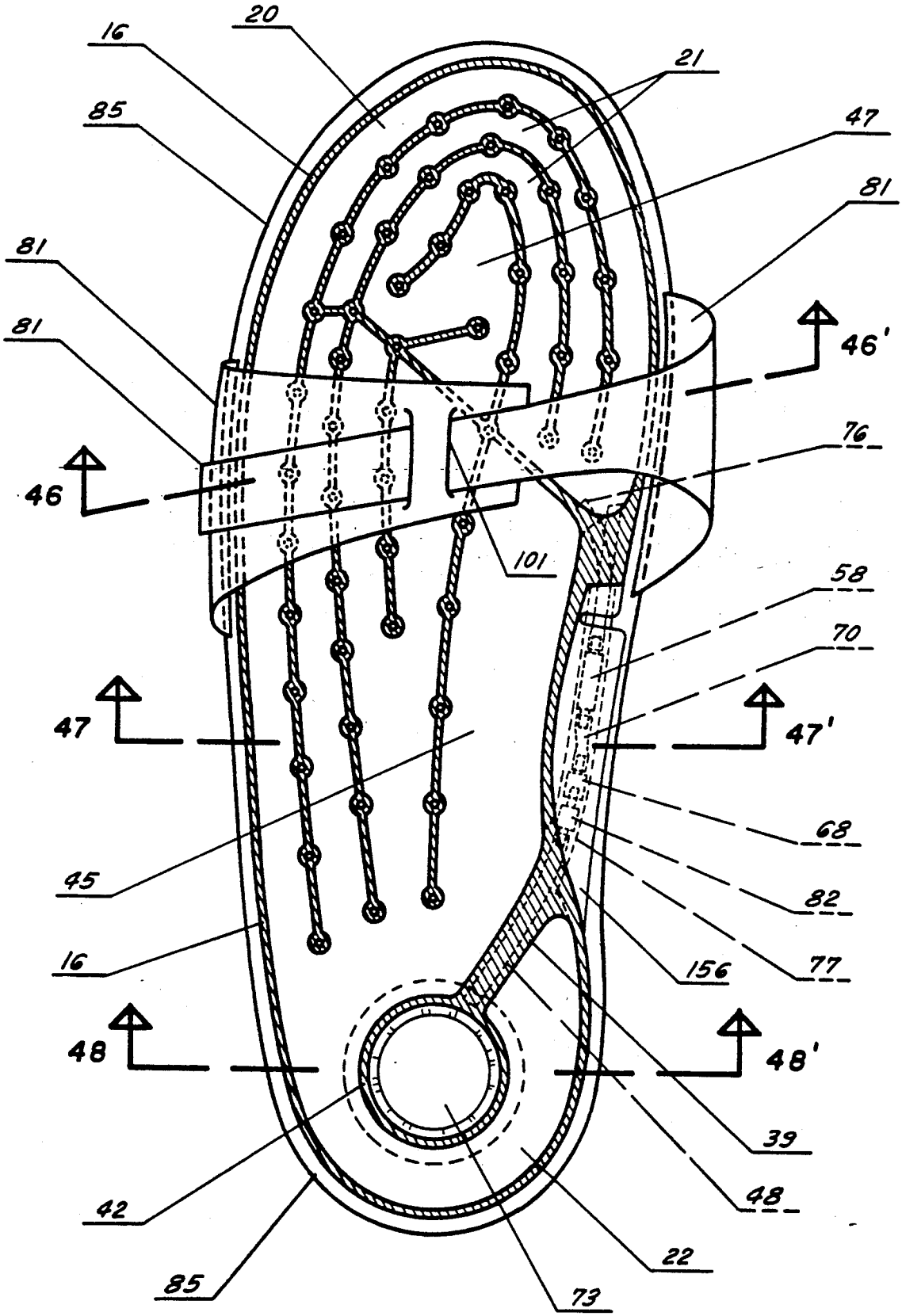
FIG. 45 is a plan view of an alternative inflatable inner sole for a sandal.
Figure 46:
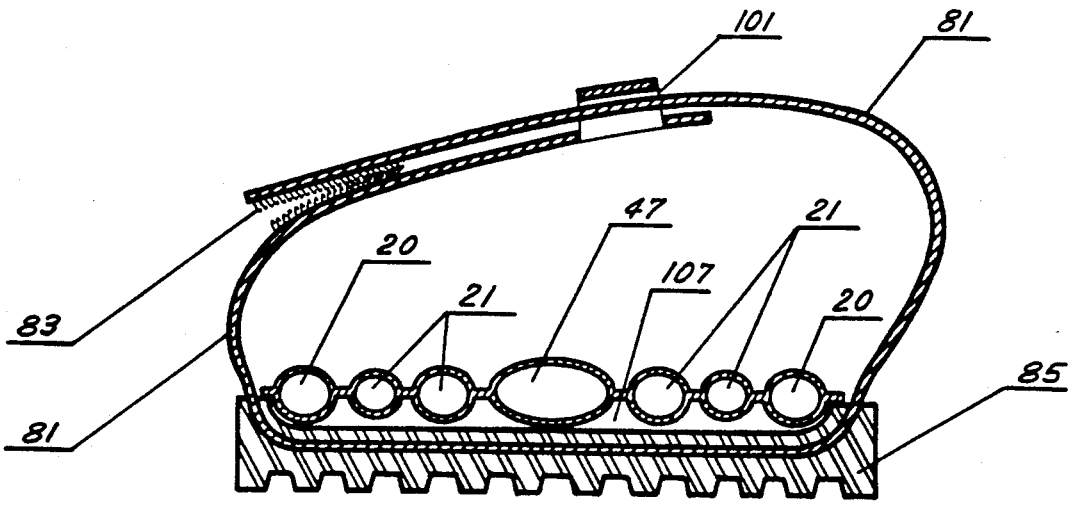
FIG. 46 is a sectional view along line 46—46′ of FIG. 45.
Figure 47:
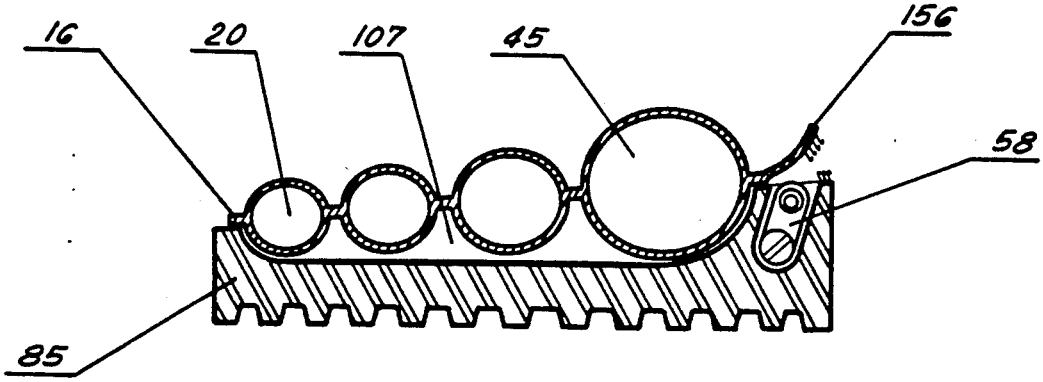
FIG. 47 is a sectional view along line 47—47′ of FIG. 45.

Referring now to FIGS. 40 through 44, there is illustrated an embodiment of an inflatable inner sole which includes a support underlayment for the inner sole. This embodiment can be for a removable inner sole for foot wear. It is especially useful, however, as a permanent member in footwear, particularly in atheletic footwear or in house shoes, e.g., slippers, moccasins, etc. Some slippers now on the market have two fabric soles separated by a space which is filled with a removable foam sole. This embodiment can be inserted as a substitute for the foam sole. The inner sole 10 is substantially identical to that shown and described with reference to FIG. 1. As shown in FIG. 44, the inner sole is used in combination with a supporting underlayment 75 which has an upwardly curled edge 88 extending entirely about its periphery, conforming to the shape of the innersole. The air pump 73 can be integrally formed with the underlayment 75, and as shown in FIG. 42, the circular channel 22 of the inner sole 10 is received within the circular trough 95 formed between the upwardly curled peripheral edge 88 and the air pump 73. Alternatively, the air pump can be formed separately as shown in FIGS. 8 and 9 and can be assembled to the underlayment 75. In this embodiment, the inlet valve to the air pump is located at the medial edge of the underlayment 75; see FIG. 44. The pump 73 has a communicating tube 48 which has a Y-shaped end similar to pump 57 shown in FIG. 4. This tube 48 can be integrally molded into the underlayment 75. The inlet check valve 82 has its open end within the shoe. The outlet, or discharge, check valve 68 is coupled to tube 70 that extends to the pressure control valve 58.

As shown in FIG. 41, a pocket 77 is molded adjacent the medial edge of the underlayment along the instep region. This pocket receives the pressure control valve 58 (see FIGS. 41 and 43) and the check valves 68 and 82 (see FIG. 44). The pocket is preferably closed with a flap 156 that can be retained closed by Velcro bands 89.

The invention can also be incorporated in footwear as an integral inflatable sole. FIGS. 45 through 49 illustrate the incorporation of the invention as a permanent member of footwear. For illustration purposes, a sandal, or clog, is shown. It is apparent, however, that the upper portions of a conventional shoe or boot could also be permanently attached to the illustrated sole. In such application, the inner sole could also include inflatable upper liners such as shown in FIGS. 29 and 30. In the illustrated application, the sandal has a conventional outer sole 85 that is provided with treads on its undersurface, and with conventional straps 81 which extend from opposite, medial and lateral sides of the upper edges of the outer sole. The straps can be molded into the outer sole 85, as shown in the sectional view of FIG. 46. The straps 81 interconnect above the arch or toes of the wearer and for this purpose can be provided with slots such as 101 and/or Velcro attachment bands 83 on opposite mating surfaces, all in a conventional manner.

The outer sole 85 can have a recess 107 in its upper surface and the inflatable liner 10 of the invention can be received within this recess. This liner is substantially as previously described with flow passageways 21 and a toe pillow 47. Preferably, the liner is permanently secured to the upper surface of the outer sole 85 with stitching, bonding with a suitable cement or glue, or by solvent welding. The permanent attachment is along the peripheral edge 16 of the inflatable inner sole. Alternatively, the inflatable inner sole can be removably attached by Velcro attachment fabric bands which can be applied to the underside of peripheral edge 16 of the inner sole and about the mating peripheral edge of the outer sole 85.

Figure 48:
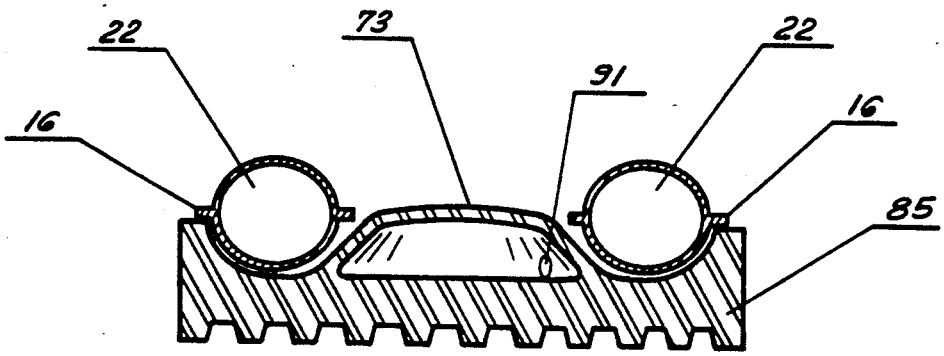
FIG. 48 is a sectional view along line 48—48′ of FIG. 45.
Figure 49:
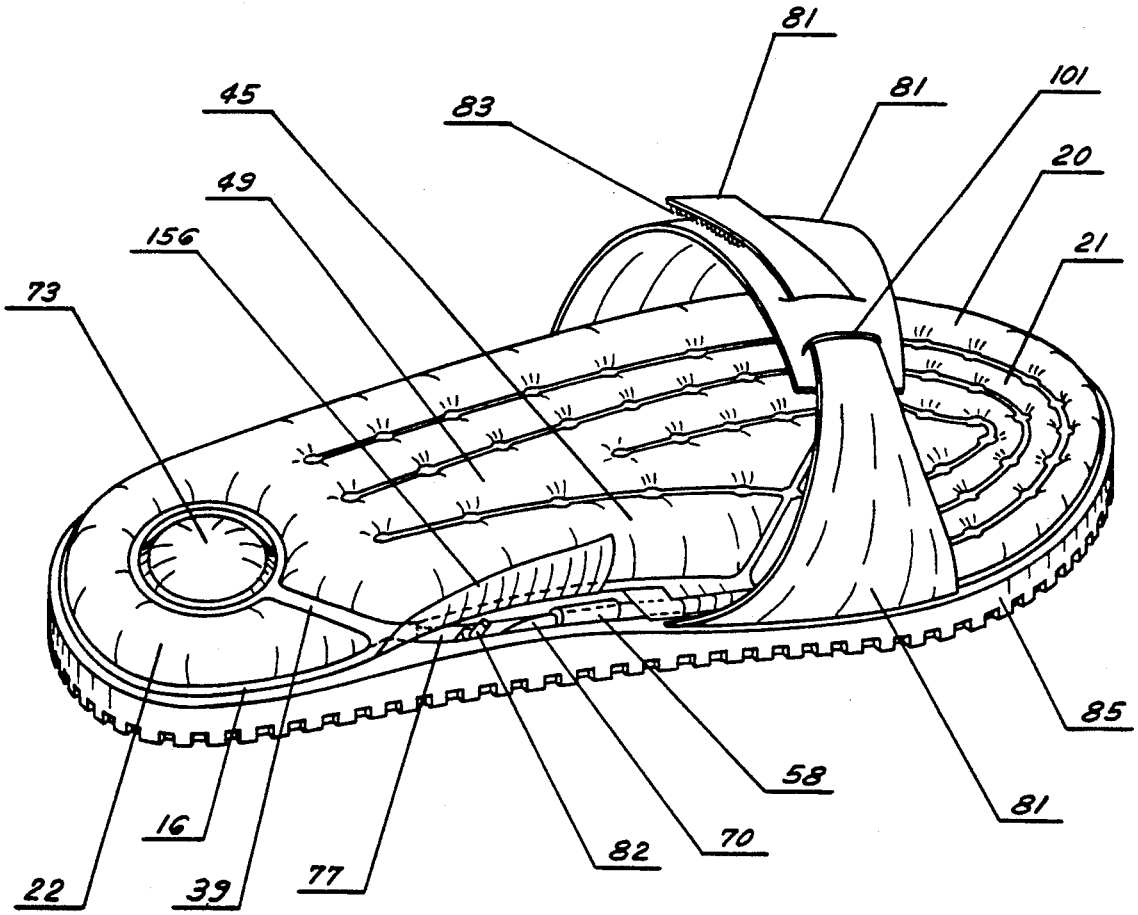
FIG. 49 is a perspective view of the inflatable inner sole of FIG. 45.

As shown in FIG. 48, the air pump 73 can be integrally molded into the outer sole 85. This is especially advantageous for a sandal as the pump is thus integral with the heel of the sandal, and no additional flap or band is needed for mounting of the pump. An aperture 91 in the sidewall of the air pump 73 communicates with a tube 48 that has a Y-shaped end (see FIG. 4) which has an inlet check valve 82 and a discharge check valve (not shown) which is connected to tube 70. As shown in FIGS. 44 and 49, tube 48 is beneath seam 39. The outer sole is preferably formed with a pocket along its medial edge adjacent the instep region to provide a recess that receives the pressure control valve 58 and the check valves 68 and 82. This pocket can be closed with flap 156 of the inner sole 10 and secured with Velcro fabric bands (not shown). In some applications, e.g., beachwear, the apertures 32 can be eliminated and the discharge tube 76 from the pressure relief valve 58 can be directed outside of the recess 107. As shown in FIG. 10, tube 76 is connected to the excess pressure relief port 74 of the pressure relief valve 58.

In all of the embodiments, the outer soles can be formed of suitable rubber or plastics, including, for example, open or closed cell foams of ethylene vinyl acetate copolymers, polyurethane, ethylene, etc.

The invention provides the advantages of an inflatable inner sole which can be inflated by the normal walking activities or which can be manually inflated by operation of a small hand pump. In either case, the firmness of the inner sole is adjustable controllable with a pressure control valve to insure exactly the desired softness and resiliency for maximum comfort to avoid fatigue. The inflatable inner sole also provides shock absorbency and can increase walking and running efficiency as it will absorb energy from impact and return it in a resilient lift to the wearer.

The pressure control valve is preferably located, as illustrated, adjacent the instep or under the arch. It could, however, be located at any other position where there is sufficient space, preferably as closely adjacent to the pump as possible.

Preferably the inner sole includes the plurality of apertures to permit fluid communication between the under side and the top side of the inflatable inner sole thus providing breathability through the inner sole. This insures that moisture doesn not accumulate on the top of the inflated inner sole. In the most preferred embodiment, the inner sole is provided with a forced air circulating pump which operates with normal walking activities to induce forced air circulation through the inner sole and the shoe. The flexing of the air passageways and the circulation of the air causes a massaging action on the soles of the wearer's feet.

The inflatable lining can be readily manufactured form flat sheets of plastic film by stamping and with solvent or ultrasonic or thermal bonding to form the seams. Of these, heat stamping in which the sheets are pressed with heat to form the seams is preferred.

I claim:

1. The combination of an inflatable sole lining having a sealed interior and a supporting underlayment for footwear which comprises:

a. a laminate of first and second sheets of plastic having the size and shape of the sole of said shoe and bonded together by a first peripheral seam about their peripheral edges to form said sealed interior and having a plurality of interconnected air flow passageways within said sealed interior and defined by tubular means extending across the surface of the sole lining and forming air channels on the top and under surfaces of said lining; and b. inflation means comprising:

(1) a flexible and resilient bulb;

(2) an inlet port opening into said bulb;

(3) a discharge port communicating from said bulb to said sealed interior of said sole lining;

(4) a pair of check valves with one each of said check valves being positioned in a respective one of said inlet and discharge ports in opposite flow directions, whereby said bulb functions as a pump, to increase the pressure of air within said sealed interior; and (5) pressure control means having a manually adjustable valve to control and maintain a desired inflation pressure within said sealed interior; and c. substantially flat support sheet beneath and coextensive with said laminate.

2. The combination of claim 1 wherein said inflatable lining has a plurality of discontinuous seams between the opposed surfaces of said first and second sheets which are disposed at preselected locations and spacings to subdivide said sealed interior into said plurality of interconnecting generally tubular passageways of preselected diameters and to form said channels on the top and under surfaces of said sole lining, inset into said first and second sheets.

3. The combination of claim 2 including a plurality of apertures located in said seams and extending through said first and second plastic sheets to provide fluid communication across said sole lining.

4. The combination of claim 2 wherein the spacing between said seams across said sole lining is greater in the arch area of said sole lining than in the remainder of said lining to provide an arch-supporting, inflatable pillow.

5. The combination of claim 2 wherein said substantially flat support sheet has a central flat recess across substantially its entire upper surface and said laminate is received within said recess.

6. The combination of claim 5 wherein said substantially flat support sheet has an upwardly curled peripheral edge surrounding said central recess.

7. The combination of claim 2 wherein said inflatable said flexible bulb is located at a preselected position on said support sheet.

8. The combination of claim 7 wherein said flexible bulb is received within an opening through said first and second sheets and surrounded by a closed loop seam located at a preselected position in said lining between said upper and lower sheets.

9. The combination of claim 8 wherein said closed loop seam is located at the heel of the sole and said flexible bulb is received therein, whereby the normal walking activities of a wearer of a shoe fitted with said inflatable sole will operate said air pump and pressurize said inflatable lining.

10. The combination of claim 9 wherein said discharge port of said flexible bulb is in communication with a flexible tube and wherein the check valve associated with said discharge port is in said flexible tube.

11. The combination of an inflatable sole lining and a supporting underlayment for footwear which comprises:

a. a laminate of first and second sheets of plastic having the size and shape of the sole of said shoe and bonded together by a first peripheral seam about their peripheral edges to form a sealed interior and having a plurality of interconnected air flow passageways within said sealed interior and defined by tubular means extending across the surface of the sole lining and forming air channels on the top and under surfaces of said lining; and b. inflation means comprising:

(1) flexible and resilient bulb received within an opening through said first and second sheets and surrounded by a closed loop seam located at the heel of the sole, whereby the normal walking activities of a wearer of a shoe fitted with said inflatable sole will operate said air pump and pressurize said inflatable lining;

(2) an inlet port opening into said bulb;

(3) a discharge port communicating from said bulb to a flexible tube said sealed interior of said sole lining; and (4) a pair of check valves with one positioned at said inlet port and the other positioned in said flexible tube, said check valves permitting flow through said bulb, whereby said bulb functions as a pump, to increase the pressure of air within said sealed interior;

c. a substantially flat support sheet beneath and coextensive with said inflatable sole lining; and d. including pressure control means connected to said flexible tube and having a pressure controlled valve means with a first discharge port communicating with said sealed interior with a second discharge port communicating exteriorly of said sealed interior.

12. The combination of claim 11 wherein said pressure controlled valve comprises a valve housing with a valve seat and a valve member resiliently biased at a preselected tension against said valve seat to maintain said valve closed against the pressure within said sealed interior.

13. The combination of claim 12 including manual adjustment means of said valve housing to permit adjustment of the tension of said resilient means and thereby permit controlled regulation of the pressure within said sealed interior.

14. The combination of claim 11 wherein said underlayment includes a pocket formed along one edge thereof, and wherein said pressure control means is received within said pocket.

15. The combination of claim 14 including a flexible flap attached to said inner liner at a location to fold over and close said pocket.

16. The combination of claim 1 wherein said flexible bulb is a hollow chamber molded into said flat planar sheet and is provided with two tubes communicated with the interior of said hollow chamber, and including inlet and outlet check valves in respective ones of said tubes.

17. Footwear having an inflatable inner sole which comprises:

d. an outer sole with a foot clasping upper portion extending from opposite edges thereof and forming a foot retainer extending over the foot of the wearer;

e. a central recess, coextensive the upper surface of said outer sole;

f. an inflatable inner sole received within said central recess and having at least a first sheet of flexible plastic having the size and shape of the sole of said shoe and bonded to said outer sole by a first peripheral seam about its peripheral edge to form a sealed interior and having a plurality of interconnected air flow passageways within said sealed interior which are in free and open air flow, and formed by discontinuous seams extending across the surface of the sole lining at preselected locations and spacings and forming air channels on the top surface of said inner sole; and g. inflation means comprising a flexible and resilient bulb carried at the heel of said footwear and including an air inlet tube with an inlet check valve opening into said bulb, and a discharge air tube with a discharge check valve communicating between said bulb and the sealed interior of said inner sole, and pressure control valve means having a manually adjustable valve to control and maintain a desired inflation pressure within said sealed interior.

18. The footwear of claim 17 wherein said pressure control value means includes a second discharge port communicating exteriorly of said sealed interior.

19. The footwear of claim 18 wherein said pressure controlled value means comprises a valve housing with a valve seat and a valve member resiliently biased against said valve seat to maintain said valve closed against the pressure within said sealed interior.

20. The footwear of claim 19 including manual adjustment means on said valve housing to permit adjustment of the tension of said resilient means and thereby permit controlled regulation of the pressure within said sealed interior.

21. The footwear of claim 20 wherein said inner sole comprises a laminate of two flexible sheets bonded together about their peripheral edges and having a plurality of discontinuous seams across their surface, thereby forming said tubular passageways.

22. The footwear of claim 21 wherein the spacing between said seams across said sole lining is greater in the arch area of said sole lining than the remainder of said inner sole to provide an arch-supporting inflatable pillow.

23. The footwear of claim 21 wherein said peripheral seams includes two parallel peripheral seams spaced apart by a distance which is greater than the spacings between said discontinuous seams in the remainder of said inner sole to thereby provide a peripheral passageway about said inner sole which has a greater diameter than said tubular passageways, to provide a stability to said footwear.

24. The footwear of claim wherein said foot clasping portion comprises a pair of straps, one each attached to opposite side edges of said outer sole.

25. The footwear of claim 24 wherein said footwear is a sandal.

* * * * *

UNITED STATES PATENT AND TRADEMARK OFFICE

CERTIFICATE OF CORRECTION

PATENT NO. : 5,025,575

DATED : June 25, 1991

INVENTOR(S) : Nikola Lakic

It is certified that error appears in the above-identified patent and that said Letters Patent is hereby corrected as shown below:

In the claims:

Claim 24, Column 16, Line 51, after "claim" insert --17--

Signed and Sealed this

First Day of December, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,025,575

DATED : June 25, 1991

INVENTOR(S) : Nikola Lakic

It is certified that error appears in the above-identified patent and that said Letters Patent is hereby corrected as shown below:

On the title page, item [63] Application Data following continuation-in-part of Ser. No. 262,749, delete "Oct. 29, 1988" and substitute therefor --Oct. 28, 1988--

Signed and Sealed this

Twenty-second Day of December, 1992

*Attest:*

DOUGLAS B. COMER

*Attesting Officer*

*Acting Commissioner of Patents and Trademarks*